US006219934B1

(12) United States Patent
Moskowitz

(10) Patent No.: US 6,219,934 B1
(45) Date of Patent: Apr. 24, 2001

(54) ROLLER VACUUM BRIDGE FOR SINGLE AND/OR DOUBLE TIER DRYING SECTIONS OF PAPER MAKING MACHINES

(76) Inventor: Max Moskowitz, 144-15 70th Rd., Flushing, NY (US) 11367

( * ) Notice: Subject to any disclaimer, the term of this patent is extended or adjusted under 35 U.S.C. 154(b) by 0 days.

(21) Appl. No.: 09/447,487

(22) Filed: Nov. 23, 1999

Related U.S. Application Data

(63) Continuation-in-part of application No. 08/472,970, filed on Jun. 7, 1995, now abandoned, which is a continuation of application No. 08/506,859, filed on Jul. 25, 1995, now Pat. No. 5,987,774.

(51) Int. Cl.[7] ..... D06F 58/00
(52) U.S. Cl. ..... 34/117

(58) Field of Search ..... 34/114, 115, 116, 34/117, 118, 119, 120; 162/206, 207, 358.1, 358.3, 359.1

(56) References Cited

U.S. PATENT DOCUMENTS 4,483,083 * 11/1984 Chance ..... 34/113
4,710,271 * 12/1987 Miller ..... 162/360.1
5,832,625 * 11/1998 Skaugen et al. ..... 34/117
5,921,000 * 7/1999 Wedel et al. ..... 34/117

* cited by examiner

*Primary Examiner*—Stephen Gravini

(57) ABSTRACT

A device for transferring a web of paper in the drying section of a paper making machine from one dryer to the next without any open draw. The device is a stationary vacuum bridge that is defined by a pair of walls, and includes rollers on one of the walls for the felt of the drying section to roll thereon. Auxiliary claims

17 Claims, 24 Drawing Sheets

FIG. 1a (PRIOR ART)
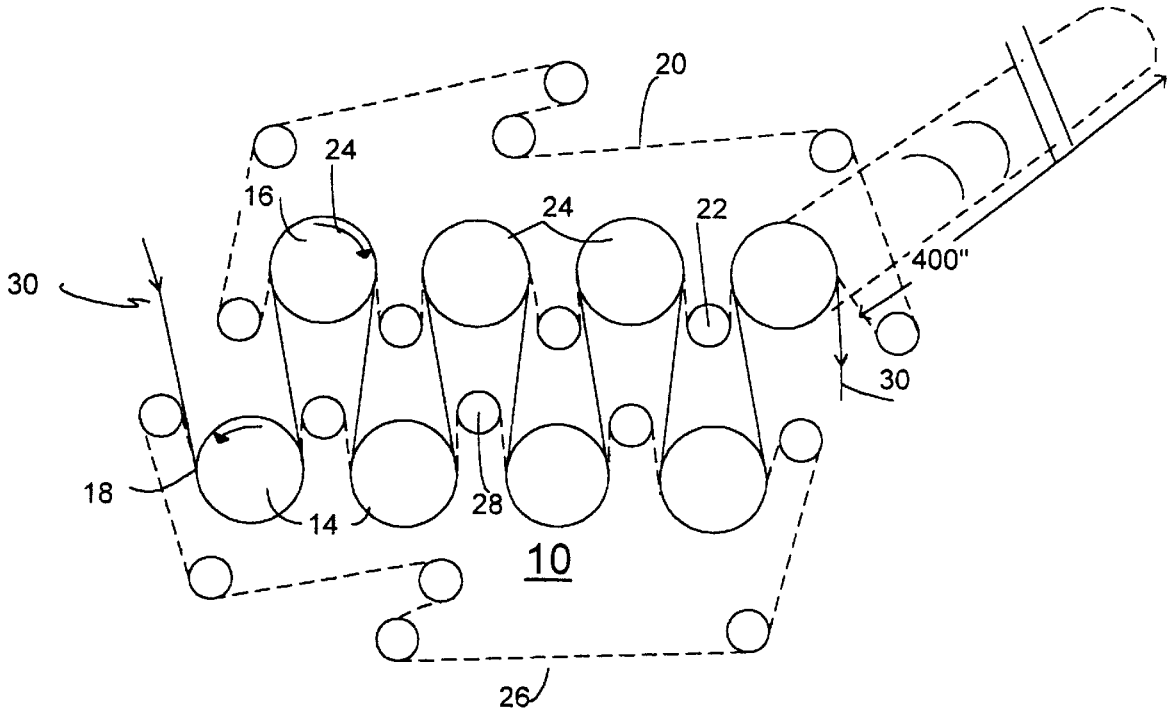
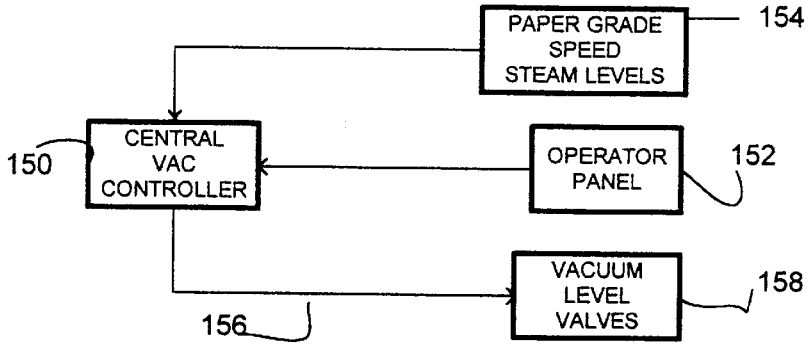
FIG. 10

FIG. 2
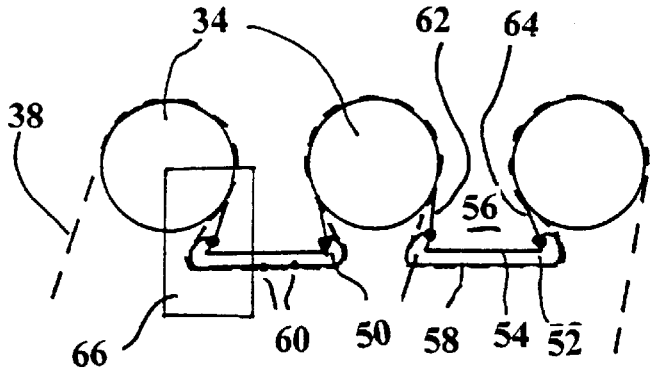
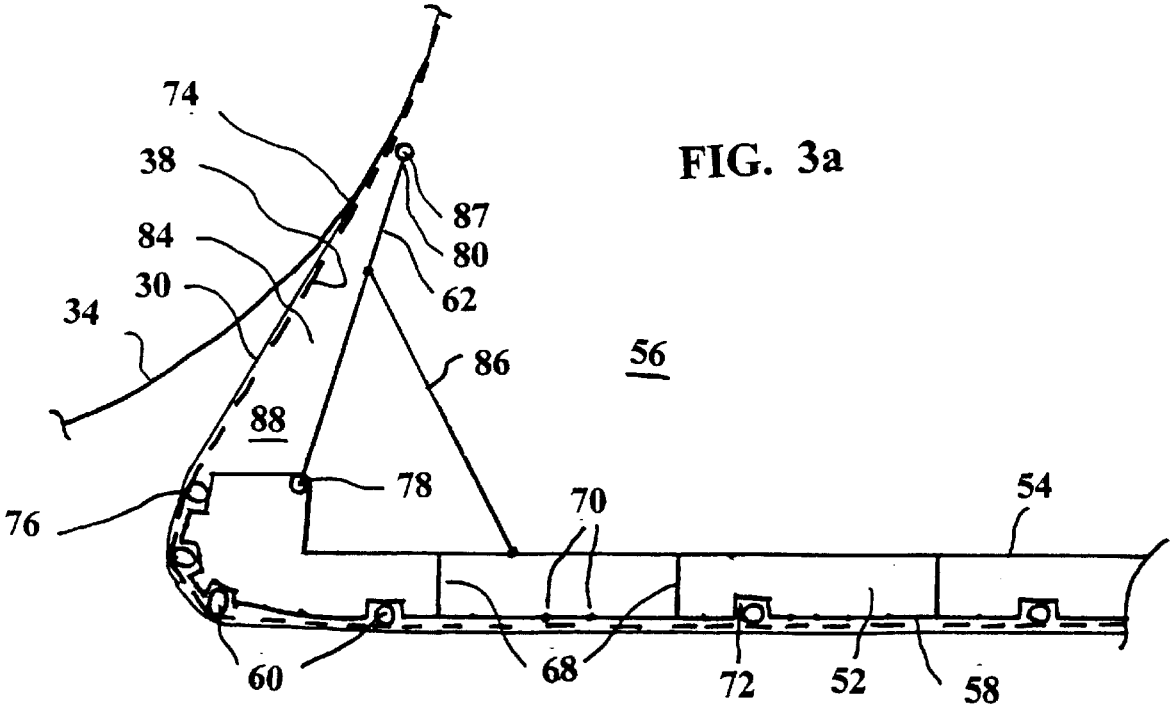
FIG. 3a

FIG. 4
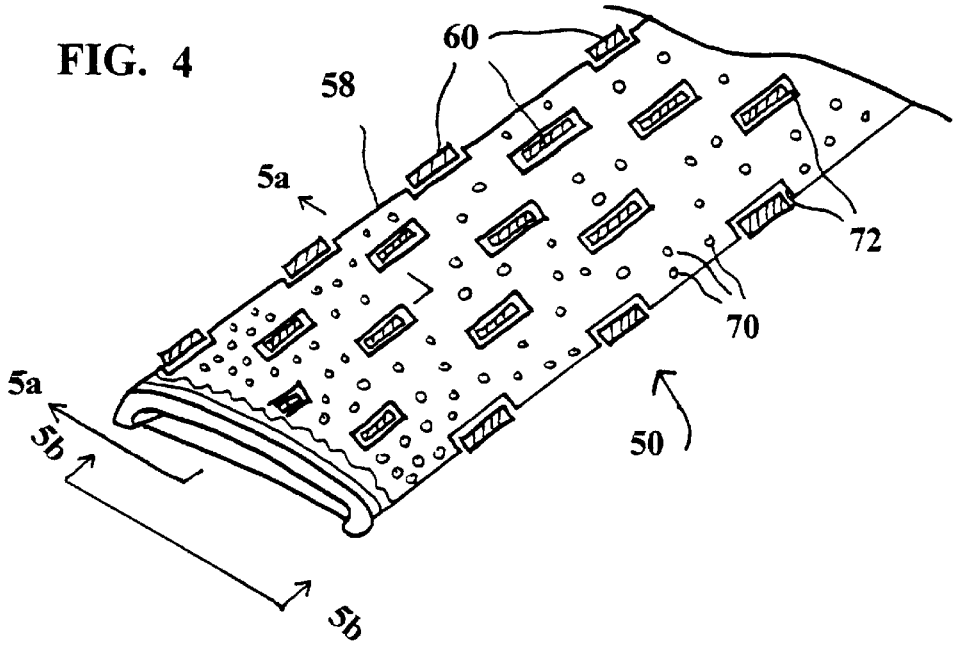
FIG. 5a
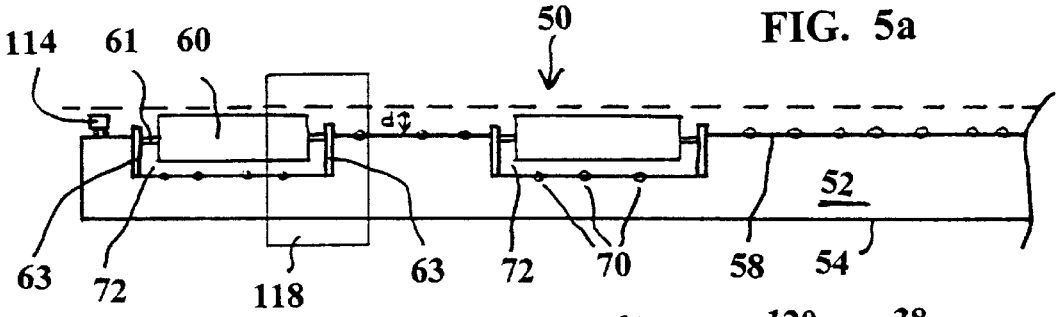
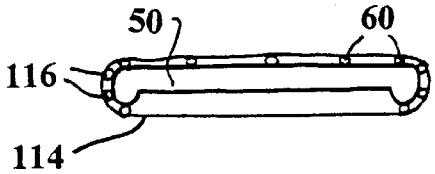
FIG. 5b
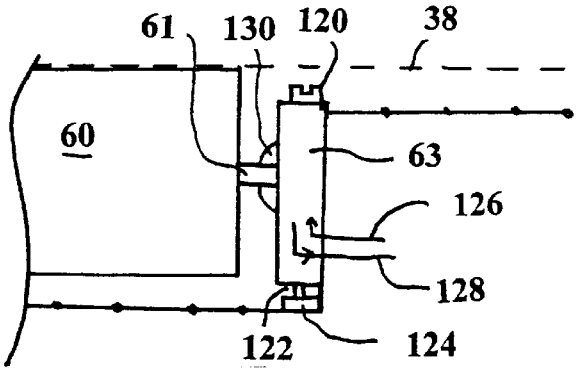
FIG. 5c

FIG. 8a
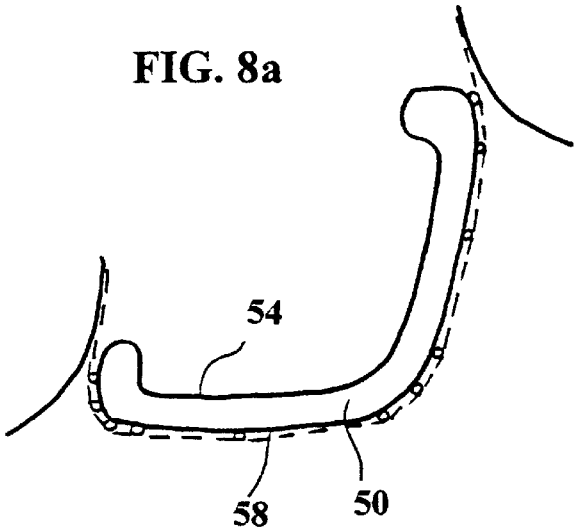
FIG. 8c
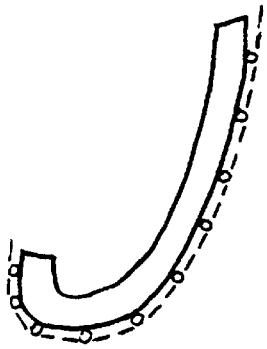
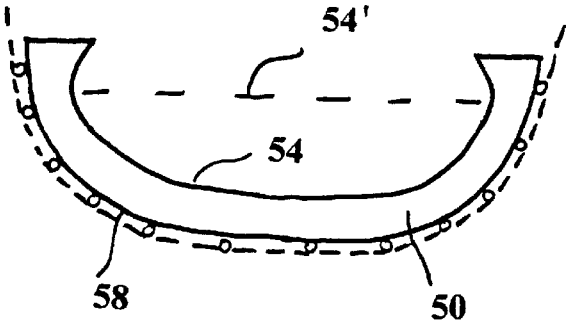
FIG. 8b

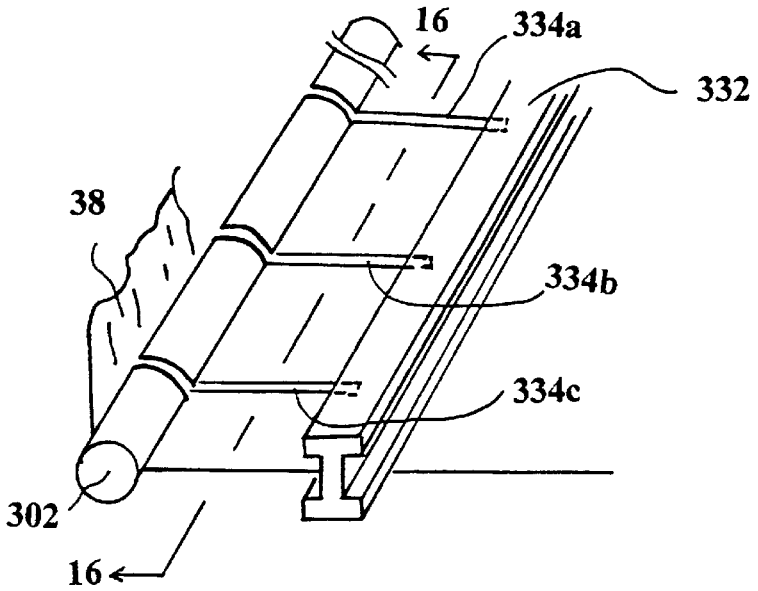
FIG. 15
FIG. 16
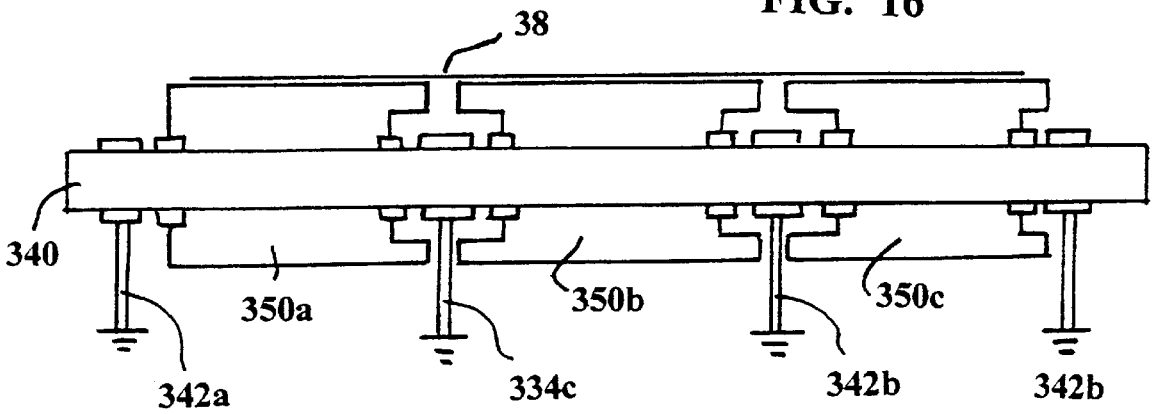
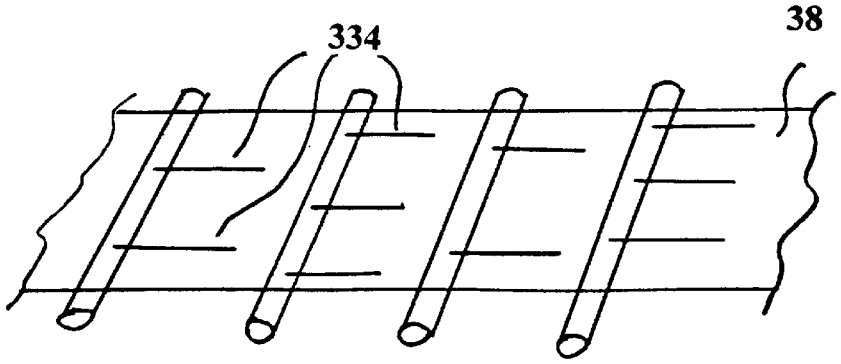
FIG. 17

ROLLER VACUUM BRIDGE FOR SINGLE AND/OR DOUBLE TIER DRYING SECTIONS OF PAPER MAKING MACHINES

This is a continuation-in-part (CIP) of application Ser. No. 08/472,970 filed Jun. 7, 1995 now abandoned and entitled: Roller Vacuum Bridge for Single And/Or Double Tier Drying Sections of Paper Making Machines and a continuation of application Ser. No. 08/506,859 filed Jul. 25, 1995 having the same title, which is slated to issue as U.S. Pat. No. 5,987,774.

BACKGROUND OF THE INVENTION

The present invention relates to drying sections of paper making machines and, more particularly, to substitutes for and/or improvements of vacuum rolls and/or felt rolls used in drying sections.

As is well known, in a single tier dryer section the drying cylinders are arranged in a line following one another. In contrast, in a double-tier dryer section these cylinders are stacked in two tiers—two lines—, the paper web meandering alternatingly between the two tiers, in a zigzag pattern.

Although single tier dryer sections were commercialized in a meaningful way only relatively recently in the early eighties, they have been described in the literature for at least a half a century. As to double tier dryers, those have been in actual use for well over a century. Accordingly, to avoid needless description of well known technology, reference is made to the following United State patents which mostly describe single tier drying sections: 1,656,853; 2,537,129; 3,448,529; 3,868,780; 4,359,827; 4,427,736; 4,483,083; 4,677,762; 4,807,371; 4,850,121; 4,876,803; 4,882,854; 4,972,608; 4,974,340; 4,980,979; 4,982,513; 5,101,577; 5,105,501; 5,135,614; 5,144,758; 5,146,696; 5,269,074; and 5,279,049. The contents of each of the above patents is incorporated by reference herein.

Common to both single and double tier drying sections, the drying cylinders are divided into groups, each group having an associated felt or fabric, in well known manner. Of relevance here is the fact that in a double tier dryer section the felt is guided from one drying cylinder the next by so-called felt rolls. Similarly, in modern single tier drying sections, the same guiding function is carried out by so-called vacuum rolls, which also go by other names, e.g. suction rolls, suction felt rolls, etc.

With the passage of time, the operational speeds and the widths of paper machines have steadily increased. For example, nowadays finished paper measuring about 400 inches in width spews out of these paper machines at speeds well in excess of 4,000 feet per minute (about 45 miles per hour) and often even faster. In other words, the machine produces in one minute a sheet of paper that is 400 inches wide and almost a mile long. To produce 400 inch wide paper, the drying cylinders of these machines have to have axial lengths of well over 400 inches. In fact, these drying cylinders are huge, not only in width but also in diameter which typically can be on the order of 6 to 7 feet. These devices weigh many, many tons. Nonetheless, these cylinders are well worth their weight and cost because they provide very large heated surfaces over which the paper web travels as it is produced, and are the very reason which has enabled the realization of very fast and efficient paper making machines.

In contrast, there is no intrinsic overpowering reason for felt or vacuum rolls to be of gigantic size. These latter devices function primarily to transfer the felt, and in the case of vacuum rolls the felt and the web, from one drying cylinder to the next. Still, these devices have to be as long axially as the drying cylinders so as to span the width of the paper machine. Moreover, their diameters must still be quite large to ensure that they will not sag or bow at their centers, which would be extremely detrimental to the reliability and runability of the paper machine. In any event, current thinking in the art is that the ever increasing machine speeds encountered today make it useful to support the paper web substantially throughout its journey through the drying section, certainly during the first few dryer sections of the drying section and preferably throughout. In this regard, paper makers speak of the need to operate their machines without any "open draw," i.e. with the paper web firmly supported on the dryers, or on the felts when the web travels between dryers, typically through the use of intermediate vacuum rolls. Therefore, many drying section designers are compelled to use expensive, massive vacuum rolls and/or very long and large felt rolls which substantially increases machine costs and machine operation expenditures.

SUMMARY OF THE INVENTION

Accordingly, a key object of the invention is to provide a drying section which obviates the need to fabricate and operate expensive vacuum rolls and/or felt rolls.

Another object of the invention is to provide a drying section which simplifies the construction of vacuum rolls and improves their operation in machine designs which insist on the use of vacuum and/or felt rolls.

A still further object of the invention is to provide a drying section which provides the advantages of a single tier drying section in a conventional two tier arrangement.

It is also an object of the present invention to provide a drying section design which substantially improves the drying cylinder heat utilization, enabling far higher paper machine speeds.

The present invention also envisions and provides a flexible dryer to dryer web transfer mechanism that will avoid spurious paper web breakages, occasionally experienced by single tier drying sections.

The foregoing and numerous other objects of the invention are realized by a drying section which still employs the traditional single or double tier configurations, but which introduces a radical departure from conventional notions concerning how the paper web or the felt should be guided between drying cylinders. The invention discloses the use of a novel structure which the present inventor has dubbed the "vacuum roller bridge." The vacuum roller bridge (VRB) of the present invention is unlike any known drying section guiding roll. The bridge itself is stationary. It does not rotate around a fixed center of rotation which determines the path of the paper web, as with a conventional guiding roll. In the main, the bridge comprises a pair of spaced walls which extend in the cross direction of the paper machine and define a vacuum chamber therebetween. In the machine direction, each vacuum bridge extends in a somewhat arcuate path from one drying cylinder to the next.

The upper wall of the bridge which faces the pocket between the dryers is air tight. In contrast, the lower wall is perforated to allow the vacuum within to act on any felt or web/felt joint run that is guided over the lower wall. Further, the lower wall supports a plurality of rollers which are comparatively short, small diameter cylindrical bodies which protrude a very small distance beyond the lower wall, for example, an inch or two or so. These rollers are distributed in spaced relation to each other over the lower wall, lengthwise and widthwise of the drying section.

In operation of the novel drying section of the present invention, the joint run of felt and web, which conventionally is guided over a vacuum roll between adjacent dryers, is instead guided over the vacuum roller bridge. In doing so, the felt engages and travels over the rollers without touching the lower wall of the bridge while, at the same time, permitting the vacuum exerted through the lower wall to act on the paper web by drawing it and supporting it against the felt in a manner that provides without open draw guiding of web between drying cylinders. In other words, the invention guides the web/felt over the non-linear path extending from one dryer cylinder to the other with the novel vacuum roller bridges, instead of with conventional vacuum roller.

Another embodiment of the invention uses a pair of vacuum rolls between adjacent dryers. However, unlike all known vacuum rolls, which span the entire width of the machine and which are rotatably supported solely at their distal ends, the novel vacuum rolls of the present invention are substantially smaller in diameter and are also rotatably supported at one or more points intermediate their distal ends, in a manner and for a purpose that is described in more detail further on.

Other aspects and advantages of the present invention will become apparent from the following detailed description of the invention which refers to the accompanying drawings.

BRIEF DESCRIPTION OF THE DRAWINGS

FIG. 1*a* is a cross section of a conventional double tier dryer section.

FIG. 2 is a cross section of a portion of a single tier dryer section illustrating the vacuum roller bridge of the present invention.

FIG. 3*a* shows further details of the vacuum roller bridge.

FIG. 4 is another view of the vacuum roller bridge.

FIG. 5*a* is a view of FIG. 4 through lines 5*a*—5*a*.

FIG. 5*b* is a view of FIG. 4 through lines 5*b*—5*b*.

FIG. 5*c* is a view of FIG. 4 through lines 5*c*—5*c*.

FIGS. 8*a*, 8*b* and 8*c* show different vacuum bridge shapes which produce different paper web paths.

FIG. 10 is a block diagram of a computer controlled vacuum system which interactively and automatically regulates the vacuum supply to the vacuum roller bridges.

FIGS. 12*h*–12*l* show further drying section concepts of the present invention.

FIG. 15 is a perspective of a portion of the guiding device of FIG. 13.

FIG. 16 is a cross section through lines 16—16 of FIG. 15.

FIG. 17 shows an additional concept applicable to the guiding device of FIG. 13.

DETAILED DESCRIPTION OF THE DRAWINGS

Figure 1B:
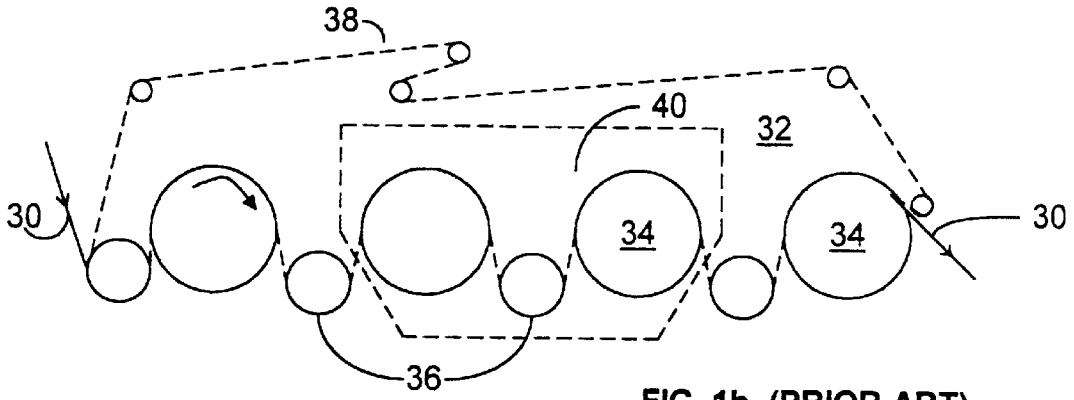
FIG. 1b (PRIOR ART)
FIG. 1*b* is a cross section of a conventional top felted single tier dryer section.

FIGS. 1*a* to 1*d* illustrate conventional drying section configurations, including in FIG.. 1*a* a double tier dryer section comprising upper drying cylinders 12 which are arranged in a top tier 16 and lower drying cylinders 14 which are at a bottom tier 18 of the dryer section 10. As seen at the right of the figure, these drying cylinders 12, 14 can measure 400 inches in their axial directions. Diametrically, they measure on the order of 7 feet. The dimensions of these already huge cylindrical structures will surely increase in the future, commensurate with the industry's continuing quest to further increase the paper production rate of these machines. As further illustrated in FIG. 1*a*, the upper dryers 12 are associated with an upper felt 20 and felt rolls 22, and rotate clockwise as indicted by arrows 24. Similarly, the lower dryers 14 have a lower felt 26, felt rolls 28, and rotate counterclockwise, as shown. In well known manner, the paper web 30 proceeds along a path that meanders between the upper and lower dryers as shown.

Note that the paper web 30 is pressed tightly against the upper dryers 12 by the upper felt 20 and against the lower dryers 14 by the lower felt 26. In between, the web 30 is free, unsupported. It is not held against a backing surface such as the dryers or the felts. In papermakers jargon, the web is said to travel in "open draw." Published articles show that, in a double tier drying section, the web is in an open draw state for about 42 percent of its path through the double tier dryer section 10.

Figure 1C:
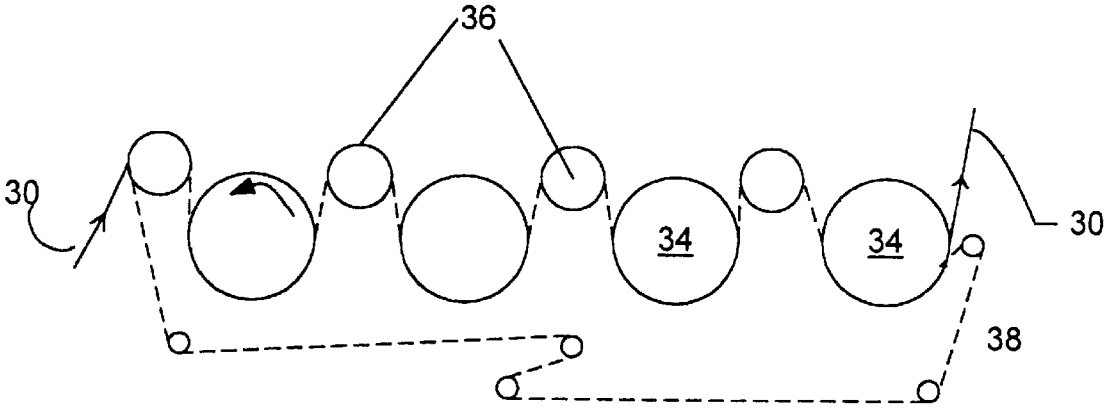
FIG. 1c (PRIOR ART)
FIG. 1*c* is a cross section of a bottom felted single tier dryer section.

A top felted single tier dryer section 32 includes, as shown in FIG. 1*b*, a row of dryers 34, vacuum rolls 36 and a felt 38 which traverses the dryers 34 together with the paper web 30 while being guided from dryer to dryer by the vacuum guide rolls 36. FIG. 1*c* is generally identical to FIG. 1*b*, except for being upside down, to designate what is referred to in the art as an inverted, bottom felted single tier dryer section. Note that the vacuum rolls 36 are situated above the dryers 34 and that the dryers rotate counterclockwise. An actual paper machine includes a total drying section consisting of several dryer groups or sections, each dryer group being either a top felted, or bottom felted single tier, or a double tier dryer group as discussed above.

Figure 1D:
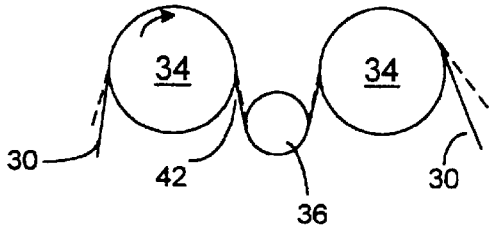
FIG. 1d (PRIOR ART)
FIG. 1*d* is an enlargement of a portion of the dryer section of FIG. 1*b*.

The pair of dryers and vacuum roll within the box 40 in FIG.. 1*b* are depicted in enlarged form in FIG. 1*d* to show the typical open draws 42 of the web 30 as the web and felt travel between the dryers 34 and the vacuum rolls 36 in a single tier dryer section. It has been reported in the literature that the web is exposed to the open draws—is not supported by vacuum-over 16 percent of its path.

Turning to the present invention, FIG. 2 illustrates a hitherto unknown structure identified herein as a vacuum roller bridge (VRB) 50 which is provided between the dryers 34 for guiding the web and felt from dryer to dryer without any open draws at all. In accordance with a preferred embodiment of the present invention, the bridge 50 comprises a vacuum chamber 52 that is bounded by an upper wall 54 which faces the pocket 56 between the dryers 34 and the bridge 50, a perforated lower wall 58, and a plurality of rollers 60 over which the felt 38 is designed to roll on its path between the dryers 34, spaced only an inch or perhaps several inches away from the perforated lower wall 58. This arrangement permits the vacuum within the chamber 52 to act via the perforated wall 58 on the felt 38, drawing the web 30 tightly against it, much like a vacuum roll. Also shown are first and second pivoting panels 62 and 64, which reach sufficiently back to the dryers 34 to extend the vacuum force sufficiently back to apply it well before the web's departure line from the dryers 34.

In this manner the bridge 50 of the present invention does away with the enormously expensive vacuum rolls 36 of the prior art. Moreover, the web 30 can be conducted through the drying section while being supported at all times, i.e. truly without any open draw, at all machine speeds.

Further features of the vacuum bridge 50 can be discerned from FIG. 3*a*, which is an enlargement of the structure in the box 66 of FIG. 2. As shown, for strengthening the bridge structure, a plurality of vertical studs 68 may be spacedly arranged throughout the vacuum chamber 52, the studs 68 extending between the upper wall 54 and the lower wall 58. The distance between the walls 54 and 58 can be several inches, in any event sufficient to allow supplying a vacuum level to the chamber 52 in the range of from 1 to 25 inches of water column. The dots 70 on the lower wall 58 represent the apertures provided throughout the wall 58, for exerting a vacuum force therethrough. The felt 38, as already mentioned, travels over the rollers 60 which are preferably supported in wells 72 that are defined in the lower wall 58. Consequently, as the felt 38 (shown as a dashed line) travels over the rollers 60, the web 30 is drawn against the felt 38 with a force that is related to the vacuum level in the chamber 52.

Since the felt leaves the dryer 34 at the point 74 and engages the bridge 50 at a downstream point 76, the present invention also provides a pivotally mounted panel 62 which is hingedly (or flexibly, e.g. by using a living hinge 78) connected to the bridge 50 at one distal edge thereof. The other distal edge 80 is situated close to but preferably a sixteenth of an inch or so away from the surface of the dryer (more precisely the felt), at a point slightly upstream of the aforementioned point 74. In this manner, the joint run 82 of the felt and web between the dryer 34 and the bridge 50 are subjected to the holding force exerted by the vacuum in the chamber 52. As indicated by the arrow 84, the panel 62 is spring loaded, i.e. biased, to pivot toward the dryer 34, and the flexible rope 86 serves to keep the distal edge 80 of the panel 62 a fraction of an inch away from the dryer. Consequently, should a thick wad of paper develop on the dryer 34, the felt or dryer will not become damaged because the wad will merely push and displace the swingable panel 62. Note the friction reducing roller(s) 87 at the edge 80 of the panel 62. While it is preferred that the panel 62 not touch the felt 38 (to avoid marking or causing felt wear), some paper makers might prefer to place the panel 62 in contact with the felt 38, to reduce vacuum fan requirements and the attendant operational costs. The rollers 87 allow the panel 62 to remain in rolling contact with the felt 38.

Figure 3C:
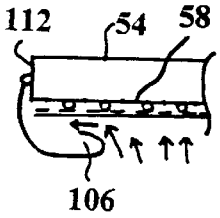
FIG. 3*c* is a view of FIG. 3*b* as seen through lines 3*c*—3*c*.
Figure 3B:
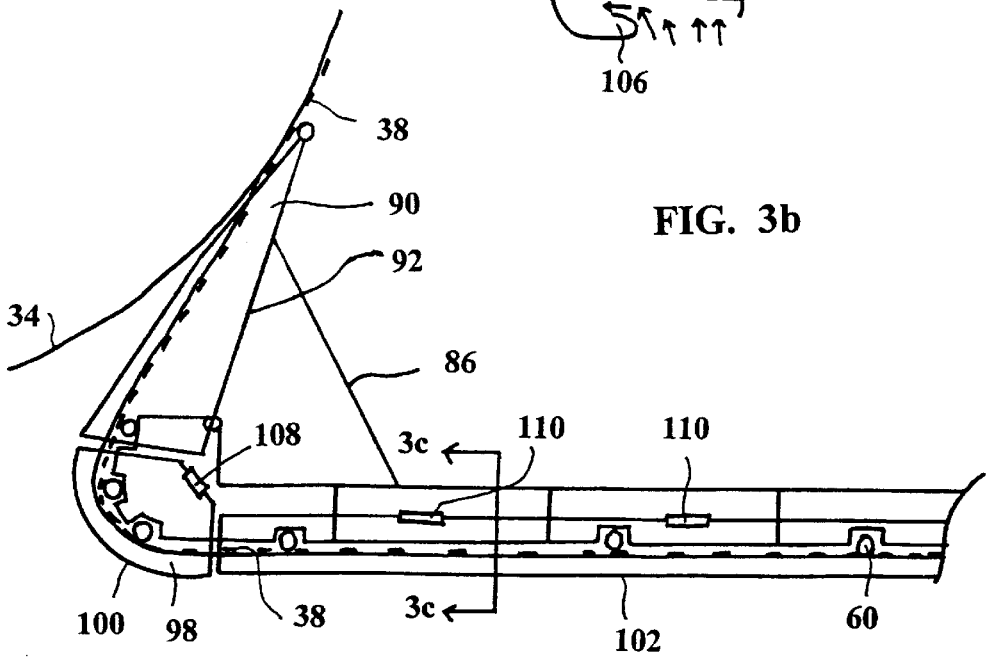
FIG. 3*b* shows still further details of the vacuum roller bridge of the present invention.

To prevent detrimental cross machine air jets possibly resulting from air drawn into the pockets 56 or from air rushing into the joint run chamber 88 defined by the panel 62 and the web/felt joint run 82, the invention preferably includes a pivotally mounted, joint run protector 90 (FIG. 3*b*). The protector 90 is generally panel shaped, and has one edge 92 which is hingedly supported at the swinging panel 62 (can also be supported at the VRB). Its other edge 94 extends toward and beyond the felt/web joint run 82 with a portion 96 thereof being preferably bent to extend in the cross machine direction. Thereby, the felt/web joint run 82 is protected from direct cross machine air currents which, if present, could cause the web and felt to separate or the web to flutter. Preferably, the protector 90 is constructed of a transparent material, since paper makers insist on being able to observe the paper web's behavior throughout the machine, and particularly where the web is susceptible to flutter.

To protect against cross machine winds at other locations, the invention also provides a corner protector 98 the curved end 100 of which is bent down so that air flowing around the protector 98 would actually be forced to travel in a path which helps to pin the web 30 to the felt 38 at the edges. A similar main bridge protector 102 is also shown for the protection of the main bridge gap 104. All of these protectors are preferably similar in that they are transparent, hinged (e.g. at 108, 110) and have lips 106 which force the air to travel around and under the lips 106 to force and hold the web edges down on the felt, as shown in FIG. 3*c*, which is a cross section of FIG. 3*b* at lines 3*c*—3*c*. Naturally, it is intended that the aforementioned protectors will be included everywhere in the drying section where they are needed. Indeed, they may be combined with conventional vacuum rolls, by being affixed at the rolls' axial ends.

It is desirable to provide an automatic mechanism to swing the protectors 90, 98 and 102 open during threading of the paper machine. Also it is advantageous to design the protectors so that a wad of paper would cause the protectors to swing out rather than break. For example, the hinges 113 may include an internal spring for urging the protectors to assume the positions shown, the holding forces being however so slight as to allow them to swing away at the lightest touch by a wad of paper. Alternatively, the hinges may be constructed as friction hinges which enable the protectors to remain in the illustrated positions despite the force of gravity. The same remarks apply to all of the protectors described here, including to the embodiment of FIG. 14*b*.

In the same vein, the present inventor intends that all of the various concepts, ideas, and embodiments that are described in connection with one embodiment shall apply in other contexts where they are applicable. For example, the protectors of the present invention will be useful with the conventional vacuum rolls 36 of FIGS. 1*b*, 1*c* and 1*d* to protect the web/felt joint runs against cross machine air currents. FIG. 3*c* also shows one of the pair of lateral walls 112 which serve to close off the vacuum chamber 52 at its lateral sides.

Figure 3D:
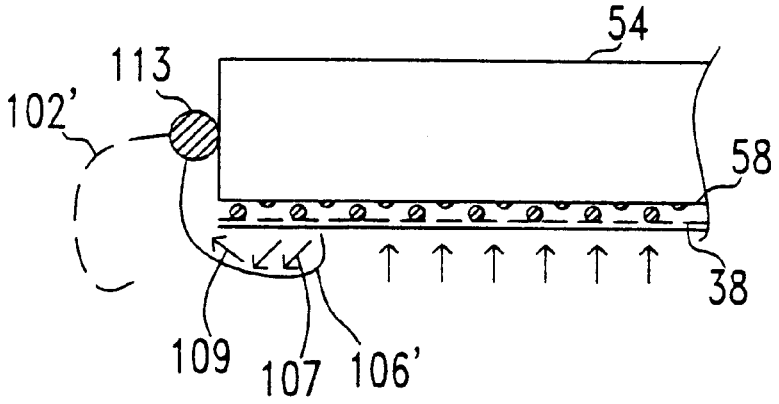
FIG. 3*d* is another view of FIG. 3*b* along lines 3*c*—3*c* in accordance with a further embodiment of the invention.

A perhaps more effective protector 102' is shown in FIG. 3*d*, which generally is similar to FIG. 3*c*. Note the modified lip 106' which is pointed at the web/felt. Air penetrating through the gap 107 expands in the interior 109 defined by the swinging protector 102', so that the pressure therein will be greater than at the lower wall 58. Therefore, the web will remain firmly adhered to the felt 38. The dashed line in FIG. 3*d* shows the protector 102' in its open position, where it might be positioned during threading of a tail or when it has beam pushed open by a wad during a web break.

The aforementioned vacuum roller bridge 50 is depicted upsidedown and perspectively in FIG. 4, to show that the rollers 60 are distributed spacedly over the lower wall 58 in a manner, number and spacing that provides sufficient support for the tensioned felt 38 which travels thereover. Typically, these rollers 60 may be a foot or two in length and 5 to 10 inches in diameter. The actual sizes are a matter of routine engineering design, which must take into consideration the strength of the roller metal, the force exerted by the felts, and other factors. Therefore, it is also possible for the rollers 60 to have lengths 10 feet or longer. Selection of the exact dimensions constitutes a simple matter of routine engineering calculations which vary with different conditions. Note that the rollers 60 are more closely spaced (in the machine direction) and/or larger in diameter where the bridge 50 curves sharply in the machine direction. The numerous circles and dots 70 in the figure designate the vacuum perforations 70 of the lower wall 58.

The cross sectional view of FIG. 5*a* shows that the rollers 60 may be supported in wells 72 formed in the lower wall 58 of the bridge 50. Each roller 60 has a shaft 61 and a pair of bearings 63 in which the shaft 61 is rotatably supported, so that the roller 60 protrudes a distance "d" beyond the lower wall 58. Quite obviously, this distance should be larger where the lower wall 58 curves sharply. As an alternative to the aforementioned main protector 102 (FIG. 3*b*), a moving strip belt 114 may be provided to reduce cross machine direction disruptive winds. This belt 114 is shown in greater detail in FIG. 5*b*, which is a view of FIG. 4 as seen in the direction of lines 5*b*. The belt 114 may roll on miniature rollers or bearings 116, in an endless loop.

Figure 5D:
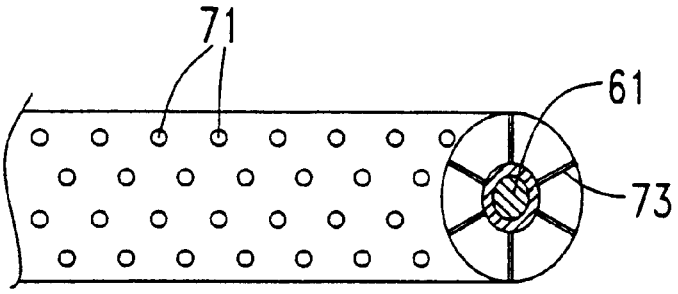
FIG. 5*d* shows the roller as seen along lines 5*d*—5*d* in FIG. 5*c*.

To ensure that all of the rollers 60 are perfectly aligned in the cross machine direction, the invention provides (as shown in FIG. 5*c*, which is an enlargement of the boxed area 118 of FIG. 5*a*) a setting screw 120 which allows adjusting the height of the roller 60 relative to the lower wall 58 by engaging and controlling the spacing 122 between the bearing 63 and the bearing pad or base 124. A the lite may be used to align all the rollers so that they present a smooth rolling plane to the felt 38. The first line 126 is for supplying a lubricant (perhaps in mist form) to the bearing 63, while the second line 128 is the return lubricant line. Many other lubricating means for the rollers will be self evident to the skilled artisan. Note the cup shaped seal 130 which may be provided to prevent any lubricant leakage. Also, the rollers may simply lie freely in the wells 72 and be lubricated by moisture that is drawn from the web and felt. To ensure that the web is subjected to the vacuum as it travels around the VRB's, FIG. 5*d* shows a roller design that has a mantel with perforations 71 and open sides which support the shaft 61 with spokes 73. Thereby, the vacuum forces also permeate the interiors of the rollers 60, enhancing the hold of the web to the felt. The perforations 70 in the wells 72 may be larger to facilitate communication of the vacuum into the rollers.

Note that the concept behind the vacuum chamber 52 can be realized by dispensing with the upper wall 54 and by making several of the apertures 70 larger and connecting them with vacuum hoses (not shown). This will establish a vacuum between the wall 58 and the felt 38 which is all that is really required for the purposes of web support, thus obtaining the equivalent of the chamber 52.

Figure 6:
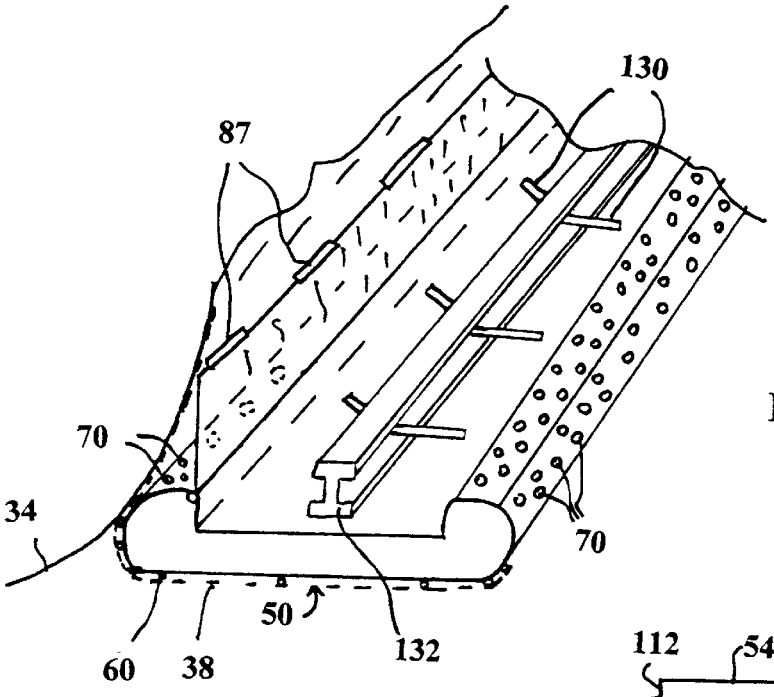
FIG. 6 shows a support for the vacuum roller bridge of the present invention.

Since the structure of the bridge 50, which consists of the pair of spaced walls 54, 58 which are further reinforced by the studs 68 is inherently very strong and resistant to bending/sagging, it may be sufficient to support the entire bridge at its extremities, in a manner which would be obvious to a mechanical designer in this field. Nonetheless, if desired the entire bridge structure can be easily attached by struts 130 or the like to a bridge support 132, for example, an "I" beam, as shown in FIG. 6. The same type of support may be used in all orientations of the bridge 50, i.e. regardless of whether the bridge 50 is oriented substantially horizontally as shown or is disposed upsidedown (for use with a bottom felted single tier dryer section) or indeed at any angle therebetween.

Figure 7:
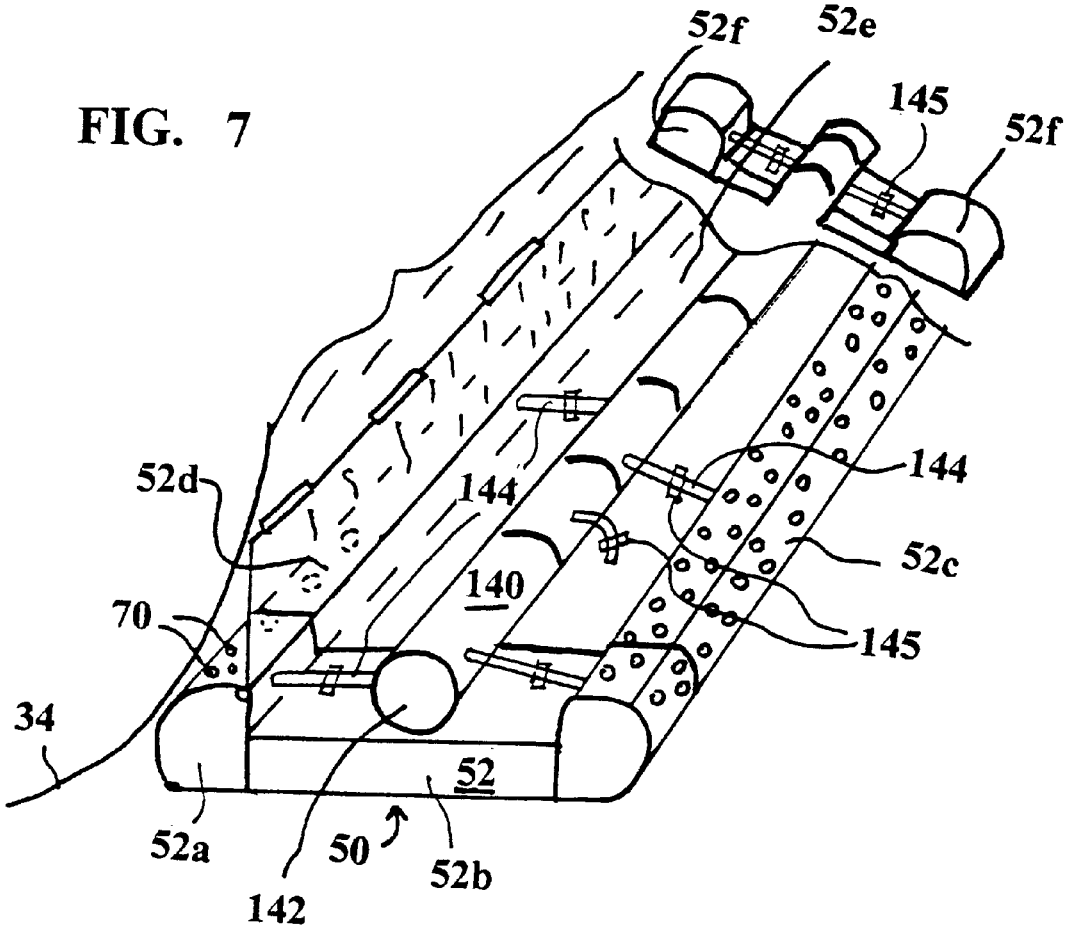
FIG. 7 illustrates a vacuum supply system for the vacuum roller bridge.

Another significant advantage of the present invention derives from its ability to easily inject and establish different vacuum levels at various regions of the VRB 50. To this end, FIG. 7 illustrates a vacuum supply system 140 including a main vacuum supply duct 142 and numerous branch vacuum ducts 144 leading into various sub-chambers of the main chamber 52. Thus, for example, it will be appreciated that the greatest vacuum may be desired at the curved regions of the bridge 50, where the paper web is subjected to the largest centrifugal forces and stresses. Accordingly, the sub-chambers 52*a* cover solely the curved tailing region which will be supplied with the highest vacuum level, particularly during threading of a tail. For a typical system, FIG. 7 suggests vacuum sub-chambers 52*a* at the front curved portions; another chamber 52*b* at the tailing end between the sub-chambers 52*a*; yet another sub-chamber 52*e* at the central portion of the bridge; and other sub-chambers 52*c*, 52*d*, 52*f*, and 52*g* located as shown. If desired, the main vacuum duct 142 may be located inside the main vacuum chamber 52.

In operation, during threading (tailing), a very high e.g. 15–20 inches w. c. might be supplied to the sub-chambers 52*a*, a slightly lower vacuum to the chamber 52*b*, and no vacuum to the other chambers. When the sheet has been fully widened, the lowest vacuum should be supplied to the sub-chamber 52*e*, more to the sub-chambers 52*c* and 52*d*; still more to the sub-chambers 52*b* and 52*g*; and the highest vacuum to the sub-chambers 52*a* and 52*f*. Of course, the means for regulating vacuum level or air flow in the conduits 144, for example with butterfly valves 145, is well known and need not be described here. However, a more sophisticated embodiment includes a central vacuum controller 150 (FIG. 10) for setting and or regulating the vacuums in all of the chambers throughout the drying section. This feature is designed to allow an operator to determine the optimal vacuum distribution for various machine conditions, e.g. paper grades, speeds, steam pressures, etc. and to command the computer 150, through the operator's panel 152, to read from a register 154 the prevailing conditions and store the optimal vacuum settings and to reestablish the same via control lines 156 and interface 158 with virtually one or two commands to the central computer or controller 150. The actual vacuum level may be set to levels needed to support the paper web against the felt in the face of centrifugal forces or other velocity related stresses or to higher levels which restrain the web against cross machine shrinkage, as described in the prior art.

Although FIG. 4 has been drawn with comparatively small sized perforations 70 in the lower wall 58 (similar to the corresponding perforations in conventional vacuum rolls), it should be appreciated that the apertures in vacuum rolls cannot be too large or too closely spaced so as to jeopardize the structural strength of the roll and its ability to remain cylindrically balanced with virtually no sagging or bowing at its center. In contrast, the bridge 50 of the present invention is not subject to these limitations. It can be mostly or overwhelmingly perforated, i.e. open, at the lower wall 58. The perforations 70 can be of any size or shape. Indeed to concentrate the vacuum towards the lateral edges where the web is subjected to the largest shrinking forces, the size of the apertures 70 adjacent the lateral ends may be larger than at the center of the bridge 50. This concept also applies to vacuum rolls generally, including to those depicted in FIGS. 1*b*–1*d*.

Further, the shape of the vacuum bridge 50 of the present invention is not limited to the general shape shown in FIGS. 3*a*, 3*b*,etc. For example, as shown in FIGS. 8*a*, 8*b*, 8*c*, the bridge 50 can assume virtually any shape, including the right angled shape of FIG. 8*a*, or the continuously arcuate shape of FIG. 8*b*, or the hook shape of FIG. 8*c*, as long as the bridge extends between dryers in a manner that provides a bridge from one dryer to the next. Nor is it necessary for the upper and lower walls to extend parallel to one another, as the upper wall 54 can extend along the dashed line 54' drawn in FIG. 8*b*.

Figure 9A:
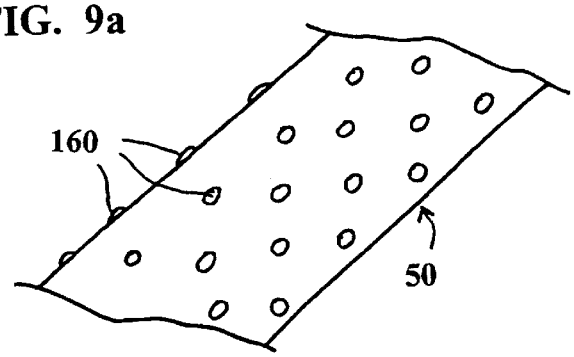
FIGS. 9*a*–9*d* illustrate several variant roller elements.
Figure 9B:
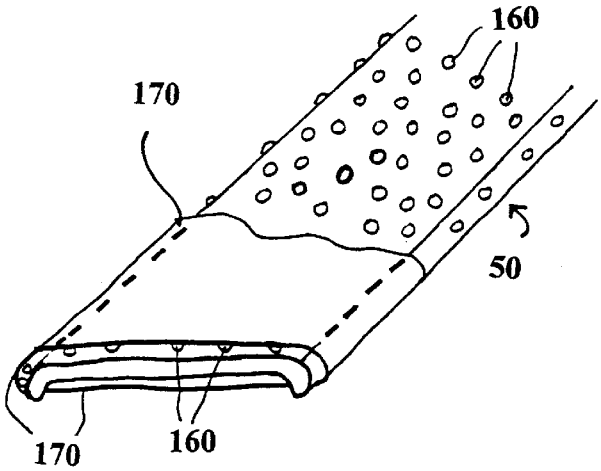
Figure 9C:
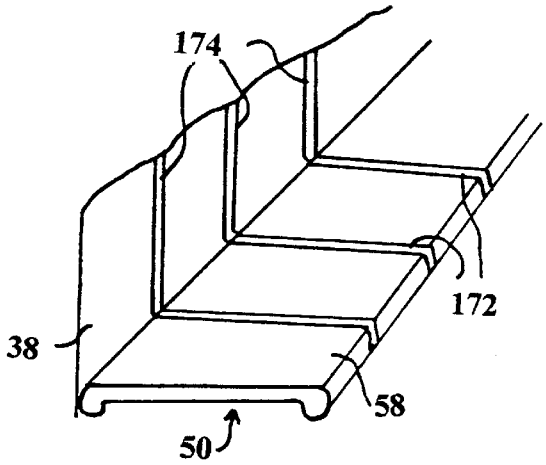
Figure 9D:
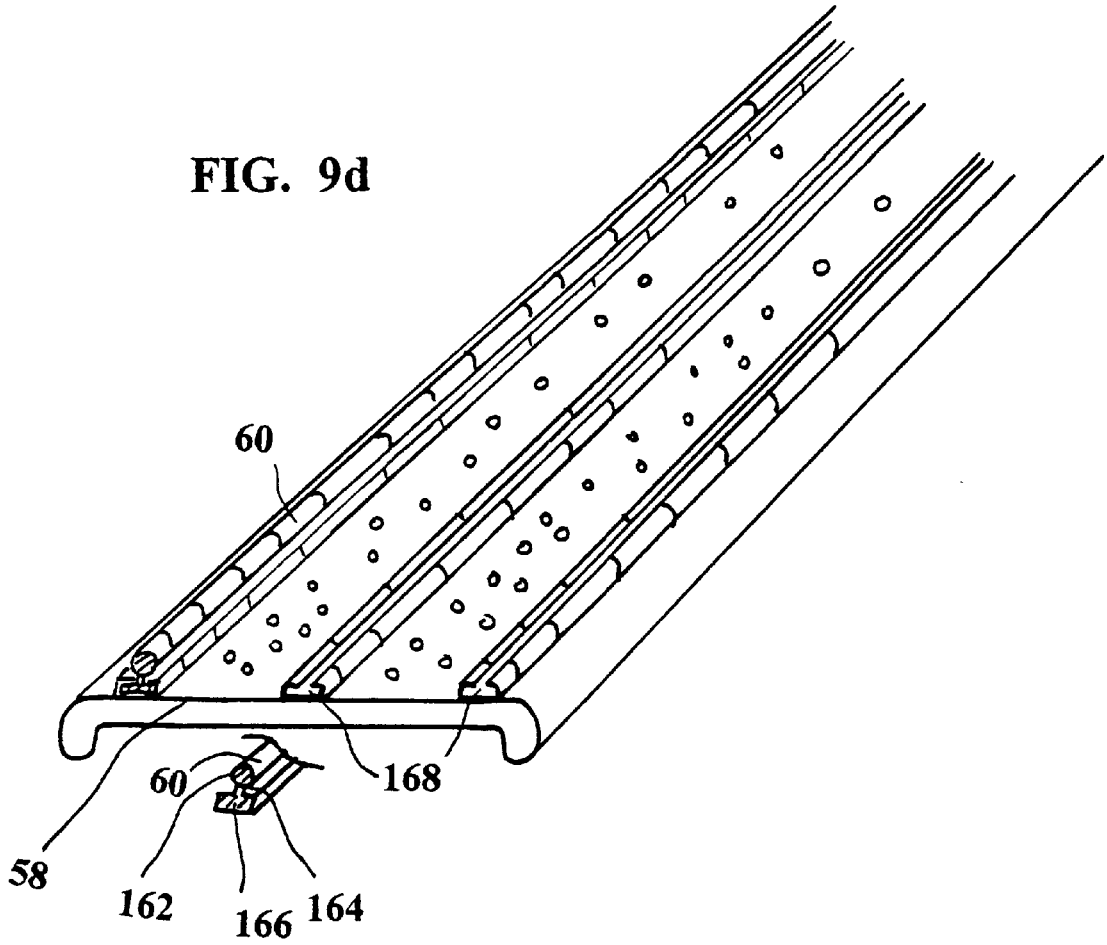

The term vacuum roller bridge in accordance with the present invention is not intended to be limited to the specific embodiments thereof which are depicted in the present patent specification. Rather, what is intended is to convey a concept—the concept being a vacuum bridge utilized by the paper web 30 to traverse the path between dryers 34 while being drawn against a felt 38, without use of the traditional vacuum roll 36 which extends across the paper machine and which is supported solely at its two distal ends. This concept encompasses providing the bridge 50 with spherical ball bearings 160 as shown in FIG. 9*a*, or with an arrangement wherein the rollers 60 of FIG. 4 extend practically continuously across the width of the machine (e.g. by being held in an open, semi-cylindrical cup 162 which is attached via a rib 164 to a rectangular insert 166 that is slidingly received in channels 168 attached to the wall 58). Another possibility includes outfitting each of the bridges 50 with its own mini felt 170, extending in an endless loop around each bridge as depicted in FIG. 9*b*. Nor is it necessary for the mini felt 170 to travel over bearings 160 or rollers 60. Rather, as shown in FIG. 9*c*, the lower wall 58 may have lubricated machine direction sliding channels 172 and the felt 170 corresponding, complementary projections 174, serving both to allow frictionless sliding of the felt 170 over the lower wall 58 in the grooves 172 and also for spacing the mini felt 170 a short distance away, i.e. below, the lower wall 58, to assure good air flow through the mini-felt 170. This requires that the projections 174 be taller than the depth of the channels 172. In operation, the main dryer section felt 38 which carries the paper web, will contact and travel together the mini-felt 170 over the bridge 50 while being subjected to the strong vacuum exerted thereon from within the bridge through the mini-felt 170.

Indeed, the last mentioned embodiment may be implemented, if desired, without a mini-felt. That is, the main felt 38, may itself be formed with the protruding projections 174 so as to slide with comparatively little friction over the lower wall 58 of the bridge 50. Also, as the technology of magnetic levitation is improved, the invention contemplates coating the back side of the main felt 38 with a magnetic coating of one polarity and creating in the bridge 50 an opposite magnetic polarity, and allowing the felt 38 to, in effect, float over the bridge 50 with little friction while subjecting the web 30 to the influence of the vacuum within the bridge 50.

Figure 11:
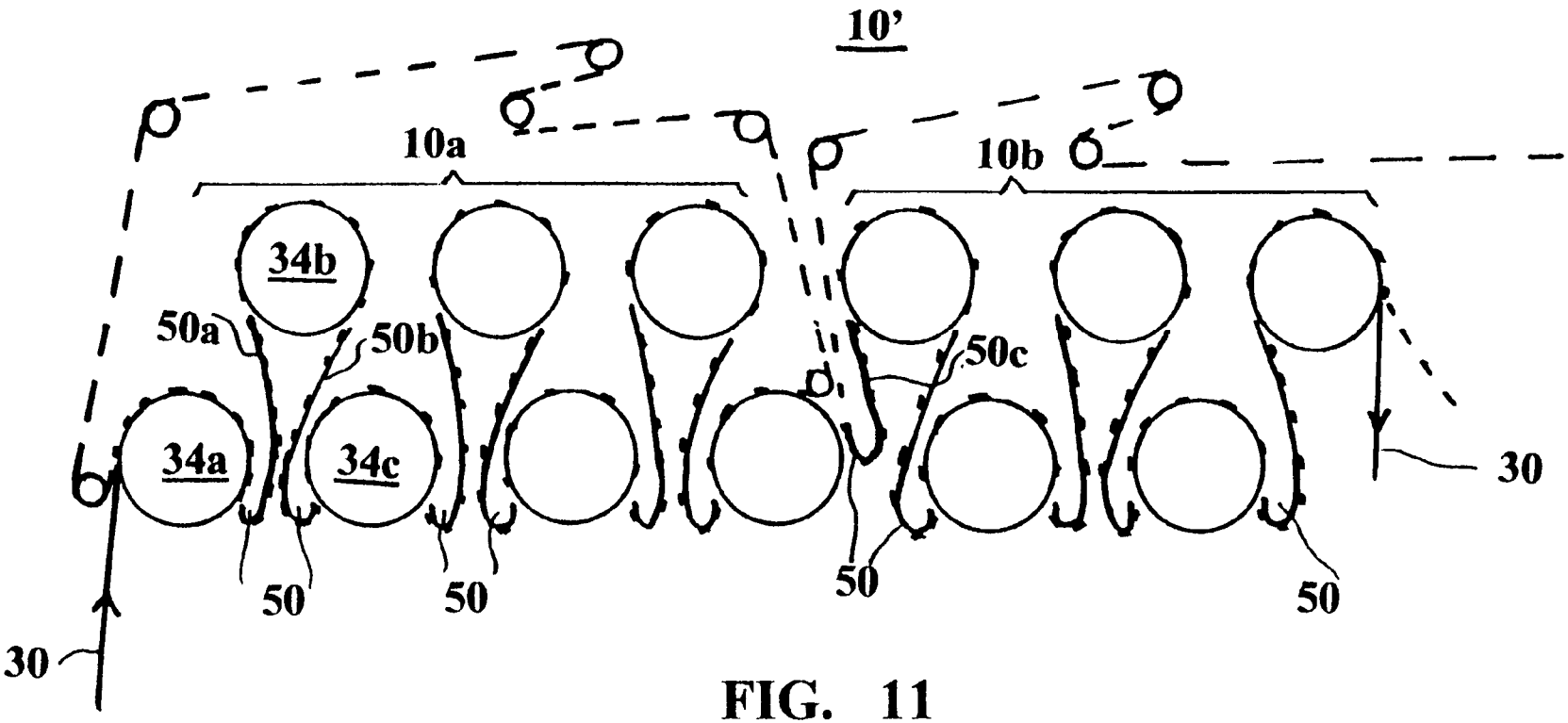
FIG. 11 illustrates an application of the vacuum roller bridge concept to a conventional double tier drying section.

One of the most significant benefits of the present invention is illustrated in FIG. 11, which depicts a seemingly conventional double tier drying bection, which has however been modified to include the vacuum bridges 50 of the present invention. The illustrated arrangement yields first the advantage of a fully supported paper web. Note that the web 30 is guided by the first bridge 50*a* from the first bottom dryer 34*a* to the second upper dryer 34*b*, without any open draw. The web 30 then continues from the second dryer 34*b* to the third bottom dryer 34*c* via the second bridge 50*b*, and so on through the dryer section 10'. One skilled in the art would recognize that the web 30 is being effectively conducted through a top felted dryer section, so that any broke falls straight down, which is highly advantageous as has been recognized in the prior art.

The transfer from one dryer section 10*a* to the next dryer section 10*b* is effected by means of the per se known lickdown transfer, which is accomplished in FIG. 11 by means of the section to section transfer bridge 50*c* as shown in the figure. Another significant advantage of the illustrated arrangement derives from the fact that the vacuum bridges 50 are located so that 80 percent (or even more) of the surfaces of the dryers 34 are contacted by the web 30. This compares to only about 60 percent in conventional double tiered dryer sections. Since the amount of heat and drying power of a dryer section varies proportionately to the amount of total dryer surface contacted by the web (and inversely to the machine speed), the roughly 20 percent or greater increase in the web dryer wrap angle should permit the machine speed and hence the paper production rate to increase by about the same percentage factor. In other words, simply by retrofitting an existing double tier dryer section with the novel bridges 50 of the invention enables one to obtain a very substantial increase in paper production. This ability represents to a machine supplier a very significant competitive advantage.

The present invention also relates to various drying section configurations in connection with which it is useful to introduce or provide the following definitions. A drying section defines the entire set of dryers provided following the press section of the paper machine and preceding the sizer (e.g. starch coater), calender or the reels. In contrast, as used here a "dryer" section relates to one group of dryers within the "drying" section. In a single tier dryer section all of the dryers are arranged in a straight line and the dryers are serviced by a single felt. The art refers to a double tier dryer (or drying) section to denote a configuration in which the dryers are disposed in two tiers, each dryer tier is serviced by a respective felt and the web passes in an open draw between the dryers. A "serpentine" dryer has the dryers in two tiers, but is not a "double tier" dryer section because there are several differences between it and a conventional double tier dryer section. It is useful therefore to introduce additional definitions. Accordingly, the instant specification introduces the terminology "bi-tier," "tri-tier," etc. to refer to a dryer section in which the dryers are located in more than one tier, e.g. two, three, etc. but which do not strictly constitute a conventional double tier or serpentine dryer section. FIG. 11 is a bi-tier dryer section in which the upper dryers are disposed in a first tier 39 and the bottom dryers in a second tier 41. It's not a double tier dryer section because it lacks the open draws or two felts of a double tier. Nor is it a serpentine dryer section, as all of the dryers contact the web directly.

An "alternating drying section" includes both top felted and bottom felted dryer section(s). Further, the present specification uses the term vacuum roll to refer to any conventional roll which applies a vacuum to the web or felt over any portion of its surface.

Figure 12A:
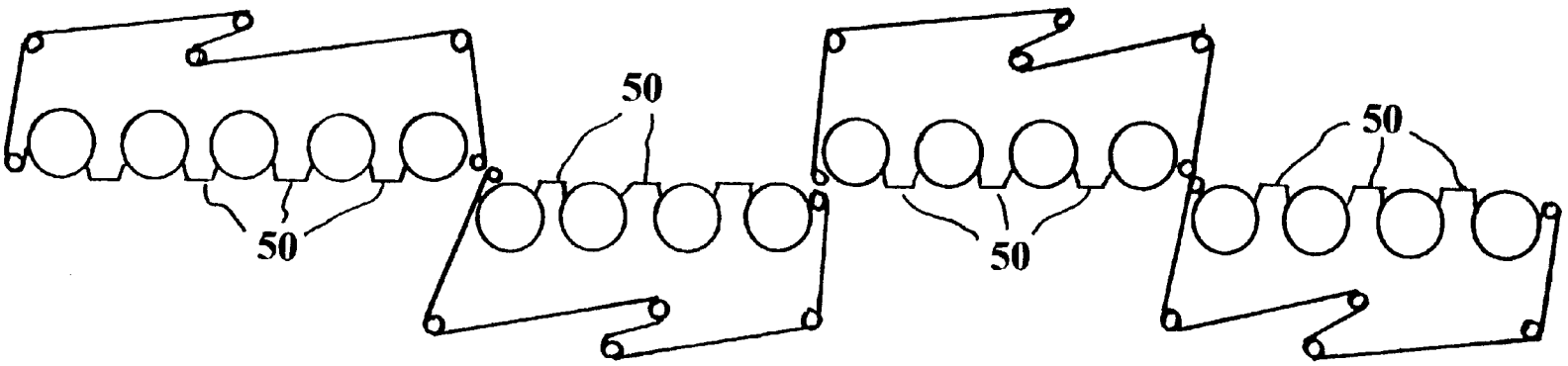
FIGS. 12*a*–12*g*, 12*c*' and 12*f*' show various drying section configurations implementing the concepts of the present invention.
Figure 12B:
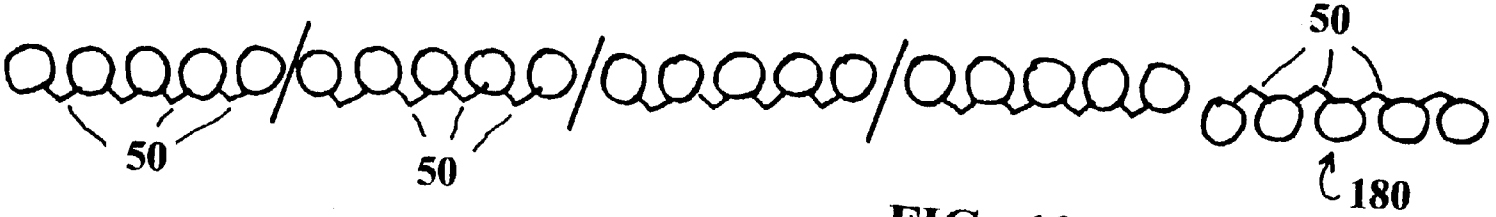
Figure 12C:
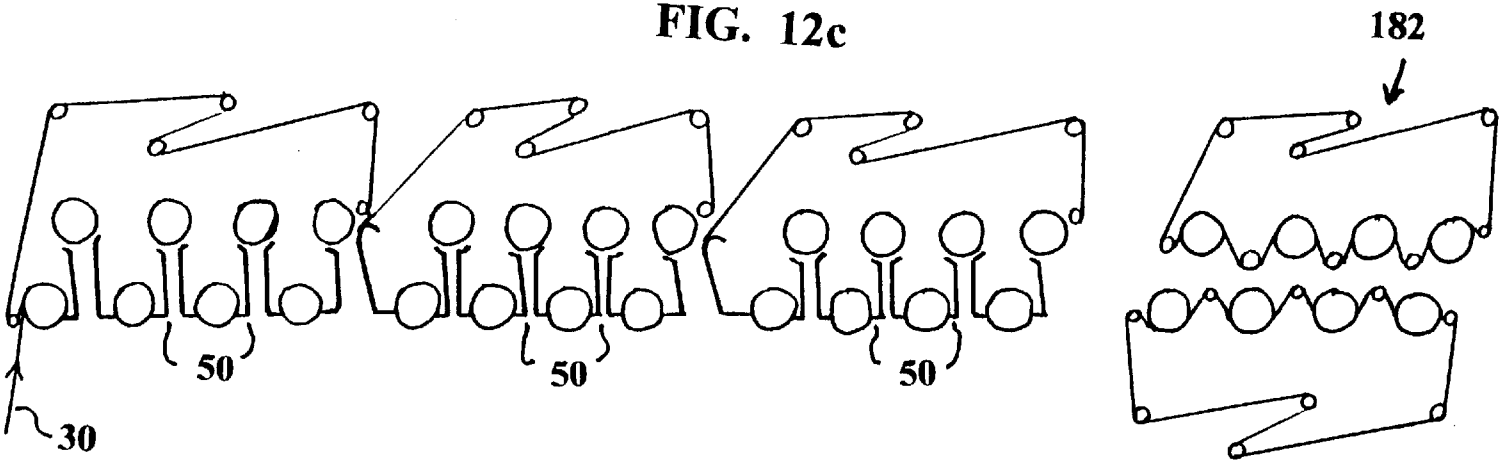

FIGS. 12*a* to 12*g* illustrate various drying section configurations utilizing the vacuum bridge concept of the present invention. Thus FIG. 12*a* shows conventional, single tier sections which alternate between top felted and bottom felted sections, which employ however the bridges 50 of this invention to convey and guide the web between dryers. The section to section web transfers may be similar to the corresponding arrangement described in U.S. Pat. No. 4,972,608. The drying section of FIG. 12*b* utilizes four or five top felted single tier sections, which terminate with one bottom tier section 180, for example to dry the top side of the paper to prevent, reduce, or inhibit curl. The bottom tier section 180 can be at the same elevation as the other sections. Again, the dryer to dryer web transfers are effected by use of the vacuum bridges 50 of the invention. Application of the invention to a conventional double tier dryer section is illustrated in FIG. 12*c*, wherein the web 30 is dried in three bi-tier sections, each of which has been provided with the vacuum bridges of the invention so as to effectively operate as a top felted, single tier dryer section. The last section in FIG. 12*c* is an unmodified, conventional two (double) tier section for curl control, if necessary and/or for reasons of cost, or for other reasons (e.g. tail cutting) for which double tier dryers are particularly useful.

A substitute for the double tier dryer section 182 of FIG. 12*c* is depicted in FIG. 12*c*', which illustrates a bi-tier dryer section 600 with dryers 602 and, most significantly, no felts and no felt rolls. The dryers are grooved as indicated by the dashed peripheral line 604 and each dryer is coupled with a vacuum box 610 which is arranged to create a suction force in the grooved peripheral surface of the dryers. The paper web 30 is guided directly around the peripheral surfaces of the dryers 602 in a serpentine path as in a conventional double tier dryer section. Here, however, the web 30 is held tightly against the surface of the dryers, not by felts but rather by the suction force, assuring good thermal coupling between the paper and the dryer surfaces. Moreover, felts retard evaporation. Here, the web 30 is freer to breath and the drying process is therefore enhanced, in part due to the suction being applied to the web. In familiar fashion, one or two of the dryers may be directly driven and the rest of the rolls may be drivingly coupled to the driven dryers by coupling belts 606 and 608 and linking speed governor 609. Preferably, the novel dryer section 600 is to be used more toward the dry end of the drying section, where the web is at least 70 to 80 percent dry and less prone to break. The paper grade and its basis weight will be used by designers to select the point where this felt-less, bi-tier dryer section will be used.

Figure 12D:
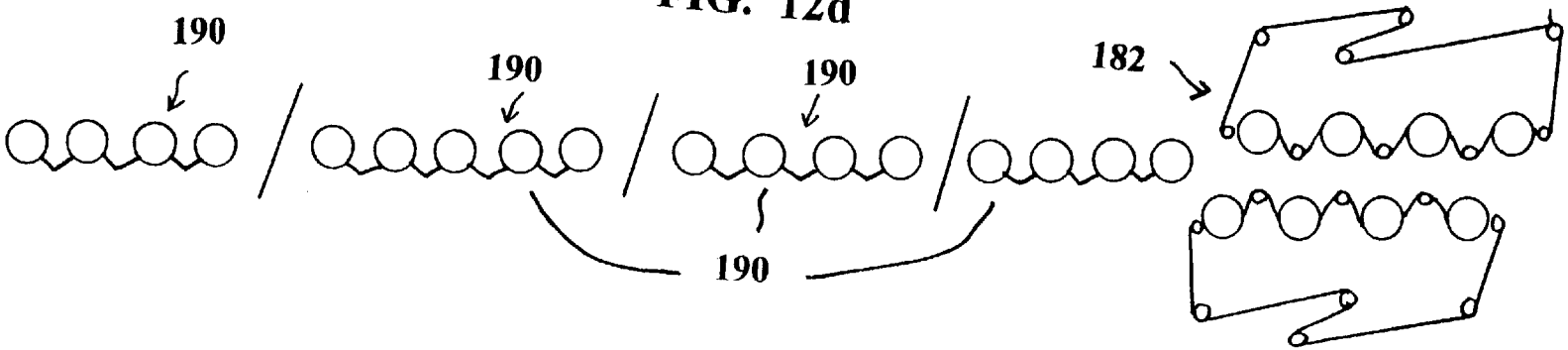
Figure 12E:
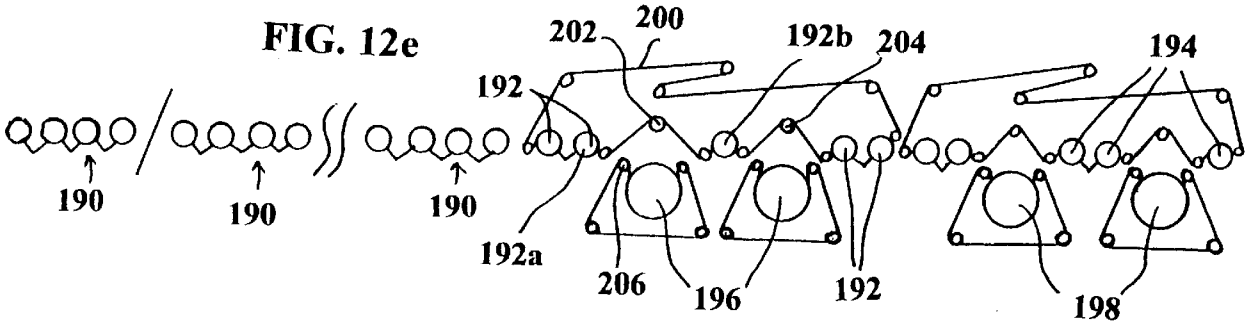

FIG. 12*d* depicts a plurality of top felted single tier dryer sections 190 with vacuum bridges 50 and concluding with a single double tier section for the reasons and purposes set forth above relative to the description of FIG. 12*c*.

Of course, nothing per se precludes the web from being guided from dryer to dryer by means of conventional vacuum rolls or felt rolls, in the embodiments of FIG. 12*a* to 12*g*. Accordingly, in FIG. 12*e* the first four top felted single tier dryer sections may use the bridges 50 of the instant invention or conventional vacuum rolls. However, the last two sections (which may alternatively number one or three) have an unusual configuration in that the section consists of top felted dryers 192 and 194 which are interrupted by individually felted bottom dryers 196 and 198. Note the unusual felt path, which takes the felt 200 from the second dryer 192*a* to a turning felt roll 202 and then to the third dryer 192*b*. A similar second turning roll 204 is located between the third and fourth dryers of this next to last section. These turning rolls 202, 204 serve to create a space for interposing at each location a single bottom felted drying cylinder 196 or 198 for the purpose of drying the other side of web, near the end of the drying section. The vacuum rolls 206 located above each of the bottom dryers 196 serve to reverse the web to enable its top side to contact these bottom felted dryers. The similarly configured last dryer section assures that there will be at least four bottom felted dryers for curl control purposes in the total drying section. It might be desirable to locate the bottom dryers 196, 198 so that the their exposed surface between the vacuum rolls is at floor level, or approximately at chest height for facilitating broke removal. Preferably, the bottom felted dryers may be larger in diameter than the top dryers 192, 194. Also, it is preferred to provide a somewhat longer path for the web between each bottom dryer and the next top dryer, so that the web may have a longer path over which to flash its moisture which has been heated by the bottom dryers.

Figure 12F:
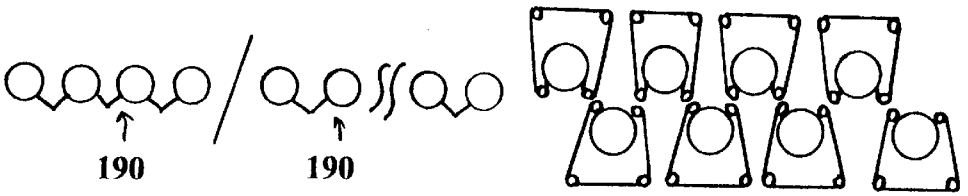

The arrangement of FIG. 12*f* includes a plurality of top felted single tier sections (with vacuum bridges or vacuum rolls or a mix of the two web guiding devices) and a last section which is in actuality seven separate sections each with only a single individually felted dryer. Further, each of the dryers is associated with its respective pair of vacuum rolls (or VRB's) and the dryers are so arranged that the web is alternatingly guided between the top and bottom dryers to dry it sequentially from opposite sides. Unlike a conventional two tier dryer section, the last dryer section 201 of FIG. 12*f*, which strictly speaking is not a section but rather eight individually felted dryers, does not expose the paper web to any open draws. An alternate arrangement for the section 201 is illustrated in FIG. 12*f*', which includes upper dryers traversed by an upper felt 203, bottom dryers traversed by a bottom felt 205, and felt guiding rolls 207 and 209 for the felts 203 and 205, respectively. This novel drying section arrangement can be followed, if desired, by one or more conventional two tier dryer sections.

Figure 12G:
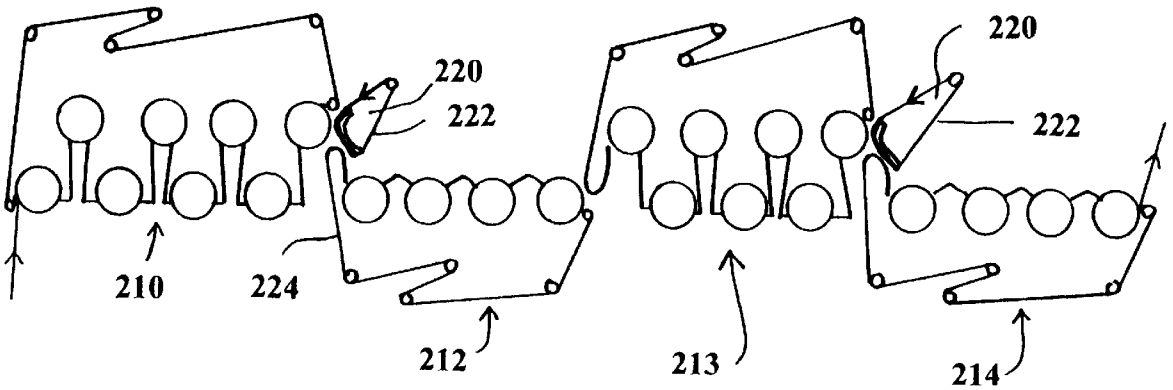
Figure 12C:
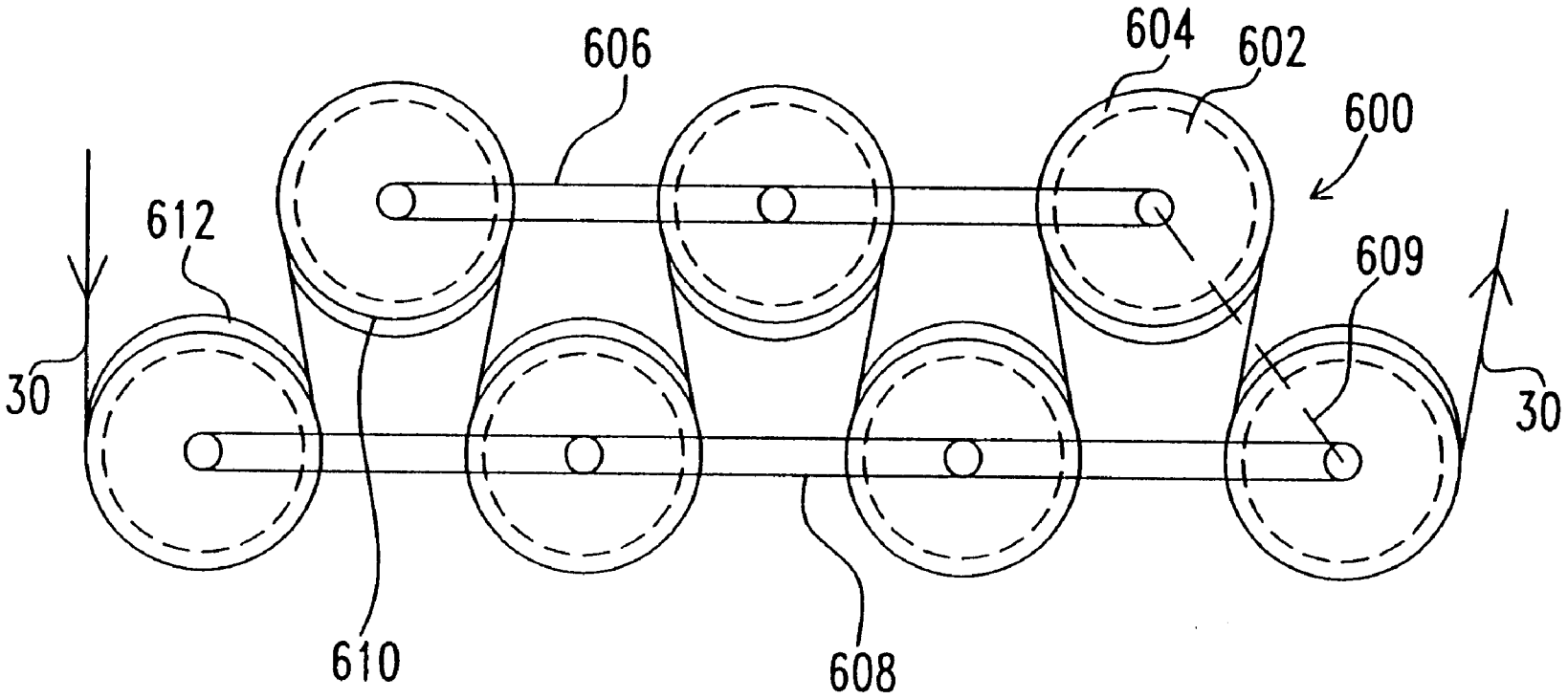
Figure 12F:
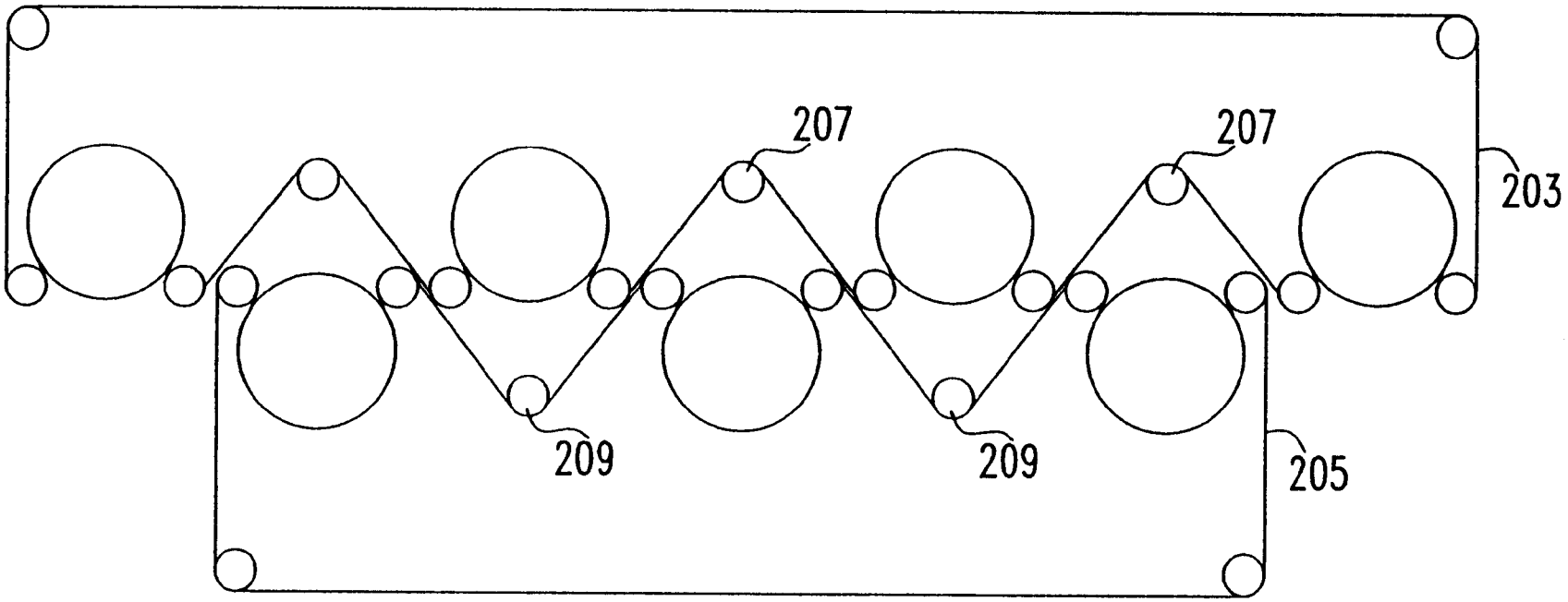

The arrangement of FIG. 12*g* includes a first, bi-tier top felted dryer section 210, which is followed by a single tier bottom felted section 212, and similar third and fourth sections 213 and 214. To reverse the web between the first and second and between the third and fourth sections, there is provided at each location a stand alone reversing vacuum bridge 220 that is served by its own short felt 222, as shown. In operation, the web is picked off the surface of the last dryer in the bi-tier section 210 or 213, in accordance with the well known lick down web transfer technique, and is carried to the felt 224 of the bottom felted single tier group 212. This arrangement takes advantage of the best aspects of both single tier and double or bi-tier dryer sections.

Figure 12H:
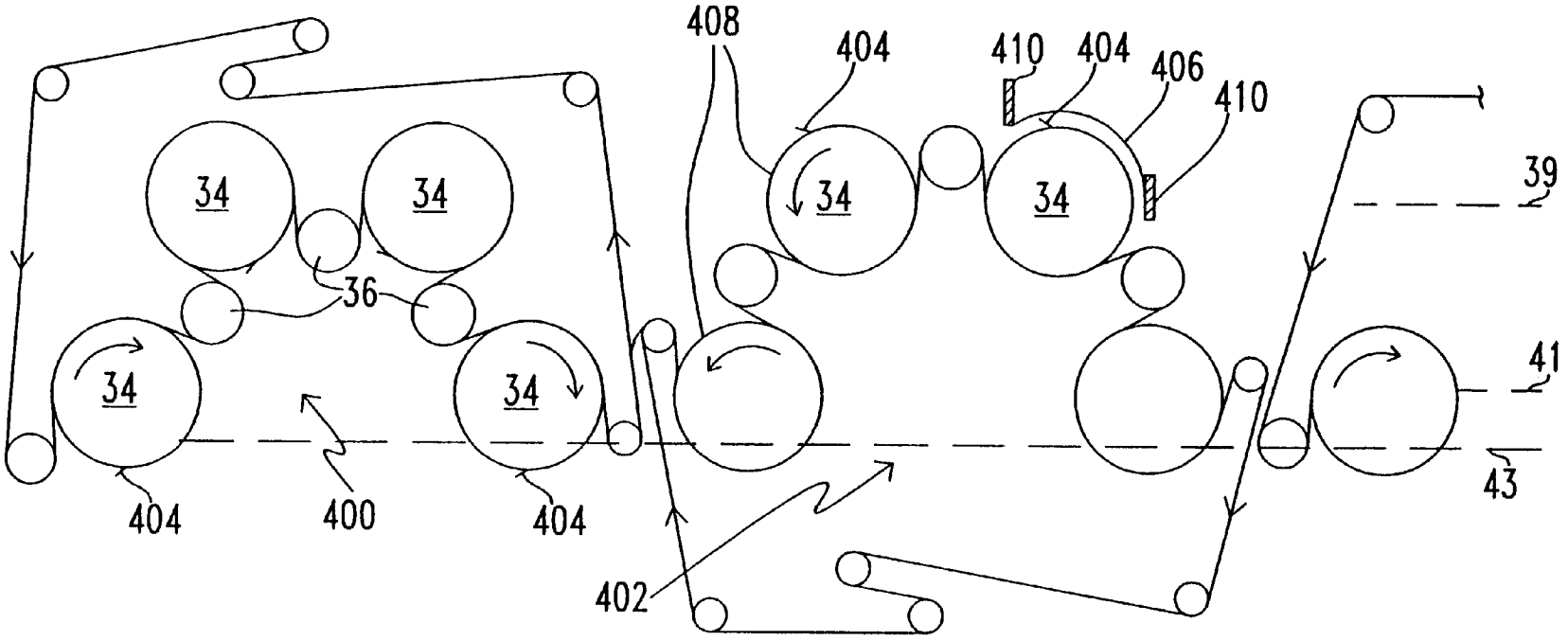

FIG. 12*h* is an alternating drying section. It includes a first bi-tier dryer section 400 which is top felted to dry the bottom side of the web (not shown) and a second bi-tier dryer section 402 that is bottom felted to dry the top side of the web. The web is transferred from group to group in the manner shown in U.S. Pat. No. 5,146,696. The comparatively long web path between dryer sections enhances the ability of the web to relax and reduces the risk of web breakages. The illustrated dryer arrangement differs from the prior art in part because all of the dryers are disposed in one or the other of two tiers 39 or 41. Papermakers prefer this arrangement to tri-tiers because the dryers are more accessible for maintenance and/or repair tasks. Also, the drying section design of FIG. 12*h* results in a shorter dryer section, an advantage usually attributed to conventional double tier sections. The dashed line 43 indicates the floor level, selected to facilitate the removal of broke from the tops of the bottom felted dryers of the first tier 41.

Bottom felted dryer sections suffer from the disadvantage of having valuable heat energy dissipate upwards from their exposed surfaces 408. A solution which is applicable to bottom felted dryers generally is in the form of a refractory cover or heat shield 406, which serves to prevent the heat from dissipating. Preferably, the shield is mounted above the doctor 404 which is normally provided with a dryer. The members 410 designate lateral supports for the shield 406 which may also be provided with means (not shown) for enabling raising the shield 406 higher above the dryers to facilitate broke removal or other maintenance or repair functions of the drying section.

Figure 12I:
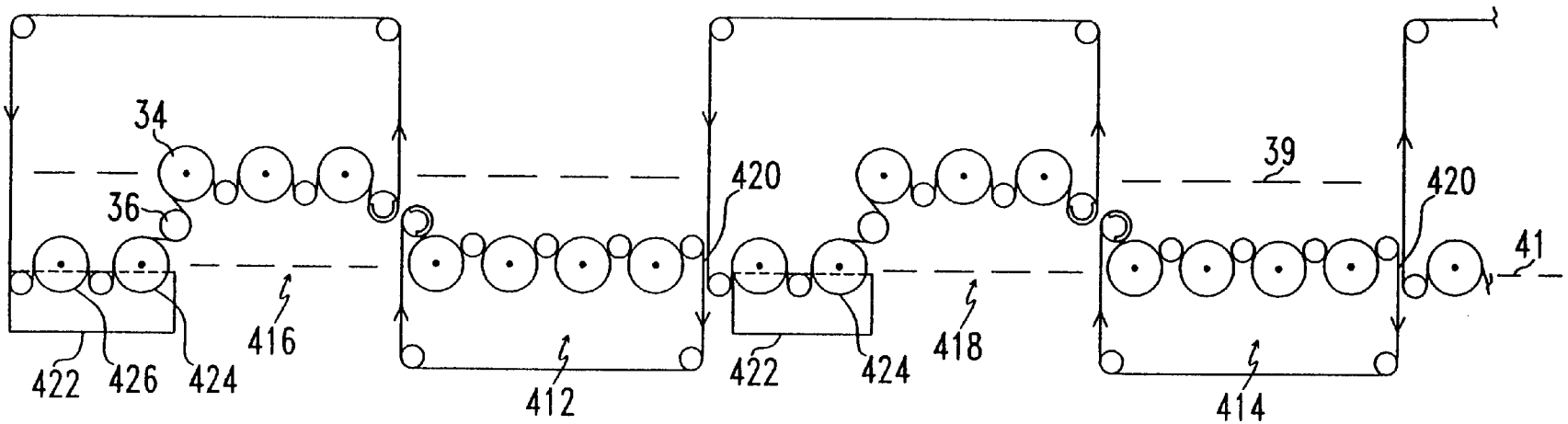

Another alternating drying section design is shown in FIG. 12*i*. Here all the bottom felted sections 412 and 414 are single tiered, to facilitate broke removal. The top felted dryer sections 416 and 418 are bi-tiered to partially obtain the benefits of a double tier machine. Note the longer web path 420 at the transfer from the bottom to top felted sections which enhances web relaxation and allows greater latitude to control the properties of the final paper product by controlling the draw between the dryer sections. In FIG. 12*i*, the first one or two dryers of each top felted bi-tier section is disposed below the floor level which is located slightly below the bottom tier level 41. To improve accessibility to these dryers, the invention also includes the concept of providing pits 422 with openable covers 424 at floor level. To service these dryers, the machine operator requires opening the covers and standing in the pit to be at the proper level to access the bottom exposed surfaces 426 of these dryers.

Figure 12J:
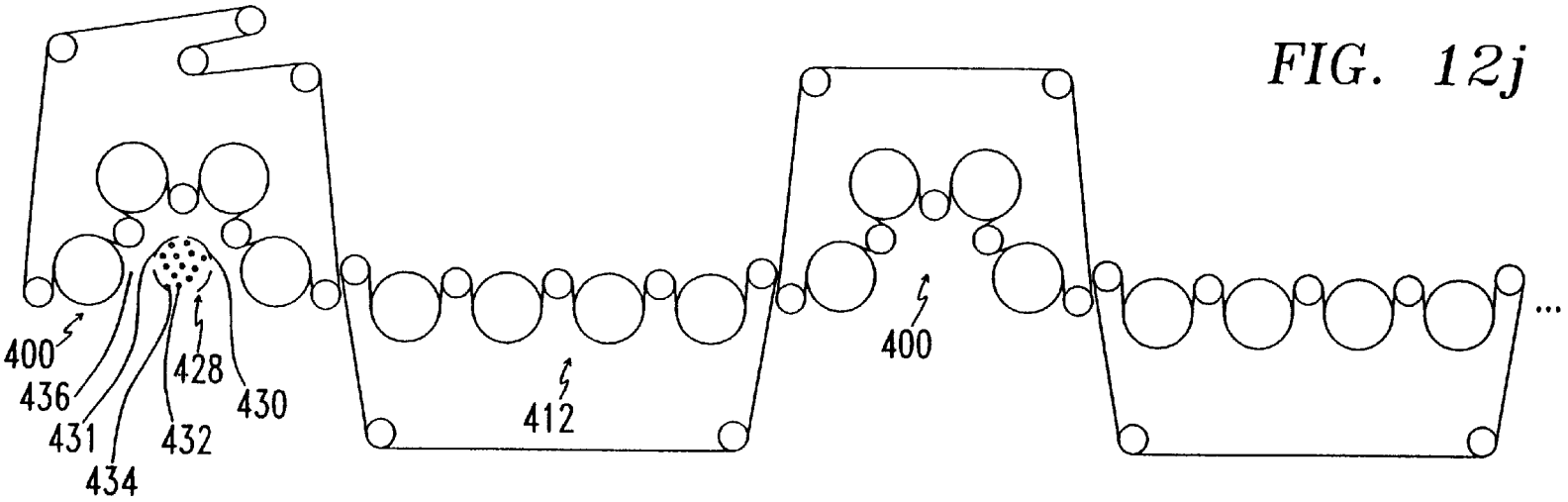

The drying section of FIG. 12*j* uses the top felted, bi-tier dryer sections of FIG. 12*h* together with the conventional, single tier bottom felted dryer sections 412 of FIG. 12*i*. Here, as with all the other embodiments, it may be advantageous to use the shields 406 and the pits 422 where applicable.

Moisture laden air released from the web tends to become trapped beneath top felted dryer sections, particularly the bi-tiered sections shown in FIGS. 12*h*, 12*i* and 12*j*. To this end, the present inventor also contemplates providing a dehumidifier 428 in the pockets 436 under the dryer sections 400, 416, 418, etc. These humidifiers 428 are cylindrical tubes, with apertures 430 through which moist pocket air is drawn in and directed against cooled pipes 432. As a result, the moisture condenses and falls down as drops 438 (FIG. 12*k*) through the open bottom 434 of the cylindrical tube (which may gave a pointed top 431 to cause broke and debris to fall). The air drawn in is vented through the open bottom, but flows back up into the pocket to promoted drying of the web, as indicated by the arrows 440.

Figure 12K:
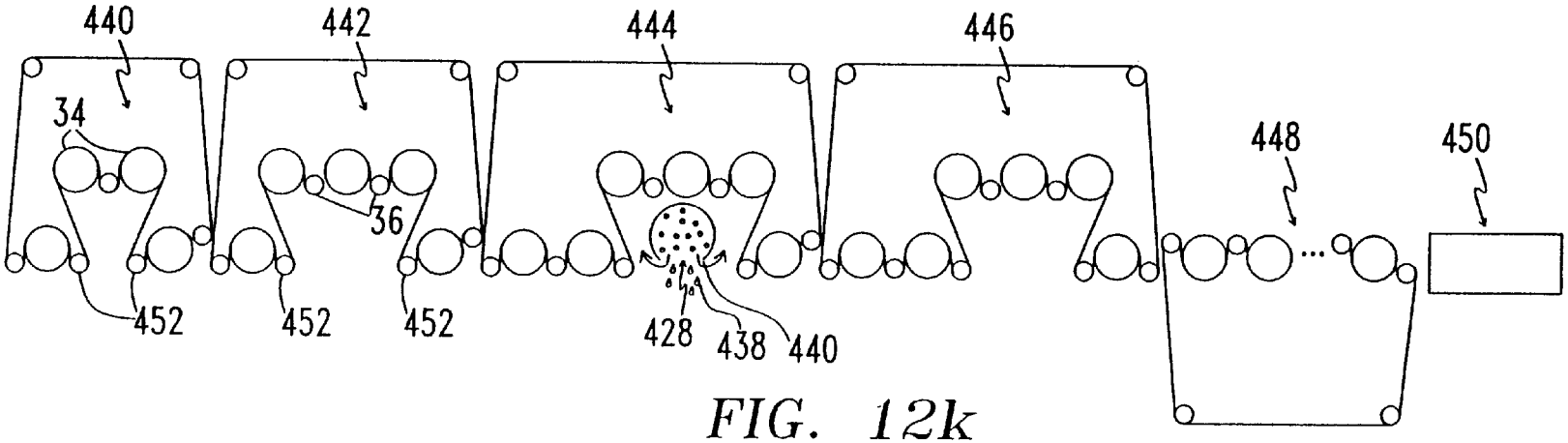
Figure 12N:
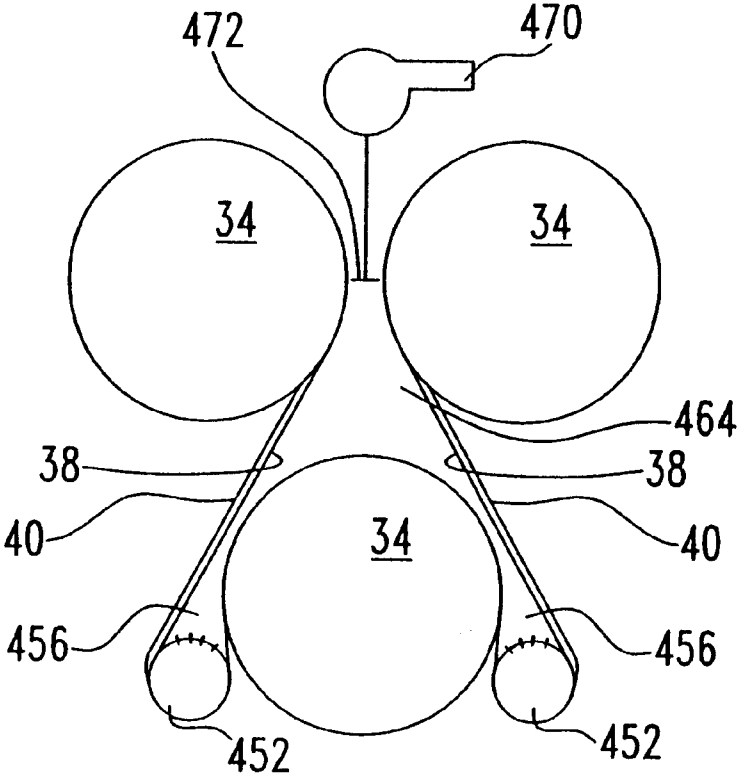
FIGS. 12*m*–12*n* shows a details of the drying sections of FIGS. 12*k* and 12*l*.
Figure 12M:
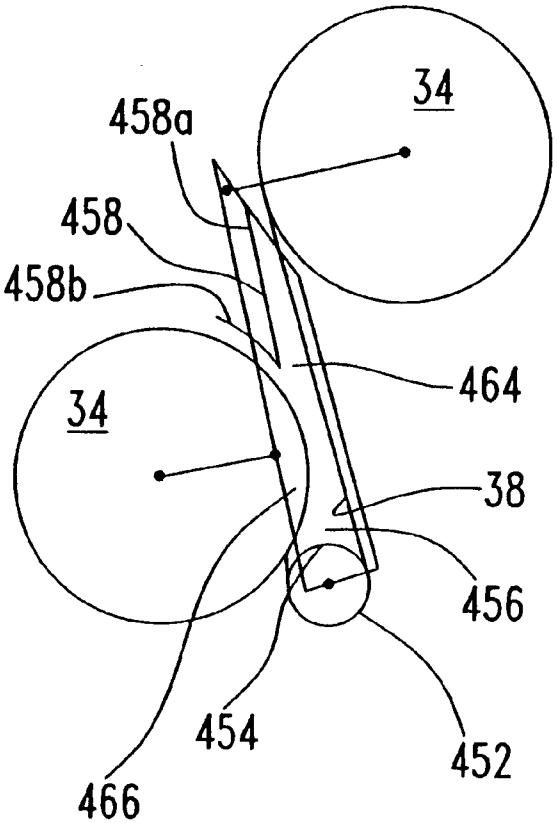

The drying section of FIG. 12*k* includes several top felted, bi-tiered sections 440, 442, 444, and 446, which are followed by a conventional bottom felted, single tier section 448 and one or two double tier sections 450. In the present embodiment, the vacuum rolls 36 are quite conventional in that they preferably include internal vacuum boxes 36' as shown in FIG. 1*d*. In contrast the vacuum rolls 452 are gutless, with their tops 454 exposed (FIGS. 12*m* and 12*n*). The felt 38 comes as close as an inch or two to the surface of the dryer 34 and defines with the roll 452 a lower pocket 456 in which a partial vacuum is established by air being drawn into the gutless roll 452. Thereby, the web 30 is held to the felt 38. To hold the web to the felt over the entire joint run of web/felt between the dryers 34, FIGS. 12*l* and 12*m* also show an air constrictor 458 with a first section 458*a* which extends in close spaced relationship to the joint run and a second section 458*b* which extends along the bottom dryer as shown. Thereby, the air along the joint run is accelerated in accordance with well understood principles of air dynamics, resulting in a vacuum zone that will ensure that the web will stay with the felt throughout its journey between dryers.

Figure 121:
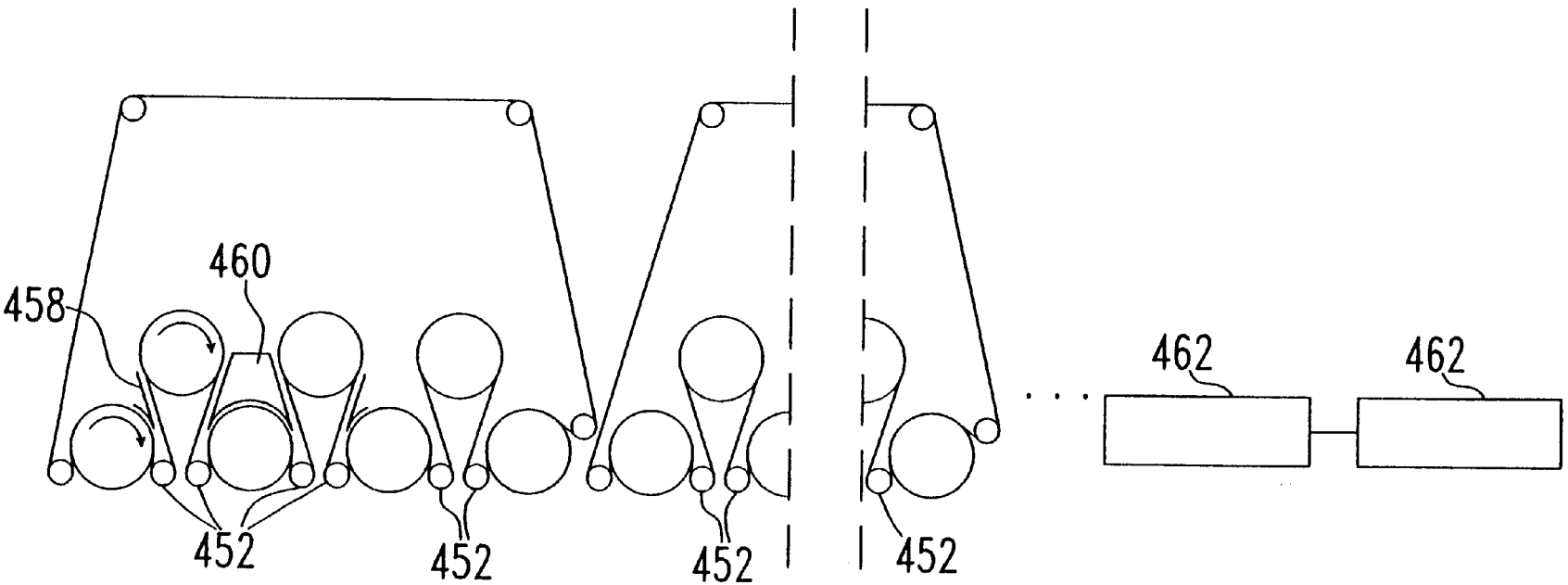

FIG. 121*l* is generally similar to FIG. 12*k*, the main difference being that there is only one upper dryer between each pair of bottom dryers as shown. Note also the air concentrating box 460 which is really a dual version of the constrictor 458. In FIGS. 12*k* and 12*l* the web is transferred between dryer sections by the well known lick down transfers shown. The boxes 462 designate bottom single-tiered and/or double tiered dryer sections. FIG. 12*m* also illustrates that all of the pockets 456 and 464 are preferably sealed laterally with protectors, e.g. protectors 466 as previously described. Also as shown in FIG. 12*n*, the upper pocket 464 may be sealed with a pocket cap 472 and an air blower 470 may be provided to assist, supplement or supplant the function provided by the vacuum roll 452.

Figure 19:
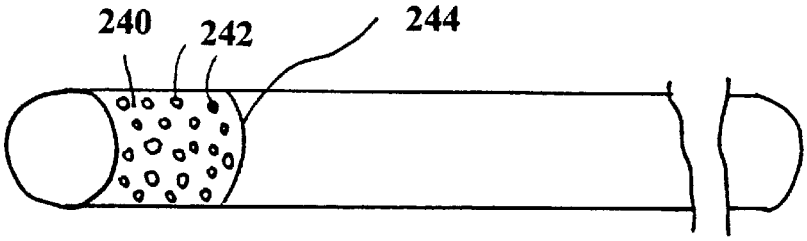
FIG. 19 shows a vacuum roll construction that is particularly adapted for use in the very last and/or in the next to last single tier dryer section.

As a general comment, it is noted that in the last several years the paper drying art has come to realize that substantially all of the shrinkage of the web occurs at dryness levels of below about 80 percent. Therefore, other than for purposes of runnability at speeds of above about 7,500 feet per minute, there is no overriding need to guide the paper web without any open draw once the paper has attained a dryness of above about 80 to 85 percent, e.g. at a point where the paper is traversing the last dryer section. Hence, there might be advantages in providing the last dryer section as a conventional two tier section or as a single tier section that employs simple felt rolls rather than the more expensive vacuum rolls. However, solely for purposes of tailing, the invention contemplates a novel partial vacuum roll (FIG. 19) that has a vacuum section 240 with apertures 242 only at one end to enable automatic threading of a tail and is otherwise of conventional construction. A solid internal wall 244 divides the threading section 240 from the rest of the roll.

Figure 13:
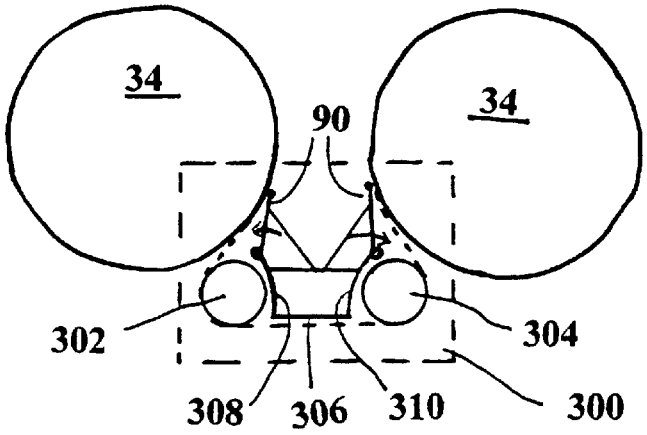
FIG. 13 illustrates another embodiment of a web guiding device for transferring the web between dryers, which employs a pair of vacuum rolls and a connecting vacuum bridge.

FIGS. 13–17 relate to a different embodiment which does not use the vacuum bridges 50. Rather, as shown in FIG. 13 a pair of gutless vacuum rolls 302 and 304 (vacuum rolls without internal vacuum boxes) are provided between each pair of dryers 34. These vacuum rolls 302,304 are unique in that they have small diameters, preferably on the order of from 5 to 15 inches (and even larger) and are supported not only at their distal ends (conventionally), but also at several intermediate points as shown in FIGS. 15–17. To confine the vacuum in the rolls 302/304 (which is introduced from the distal ends of the rolls) to where it is needed, the invention provides a horizontal plate 306 and left and right arcuate plates 308 and 310. Swinging panels 90 are also provided in the manner described previously. This arrangement confines the vacuum in the rolls 302/304 to the web/felt joint runs between the dryers and the vacuum rolls, to the web/felt runs around the rolls, and to the web/felt run between the rolls 302/304.

Figure 14A:
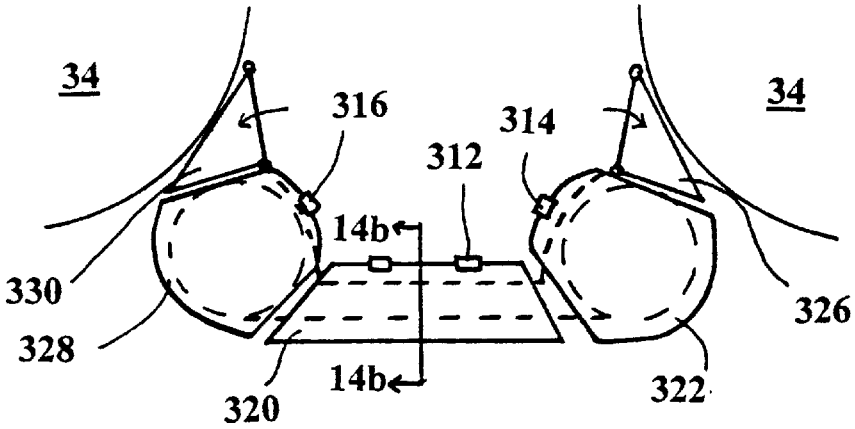
FIGS. 14*a* and 14*b* illustrate further details of the web guiding device of FIG. 13.
Figure 14B:
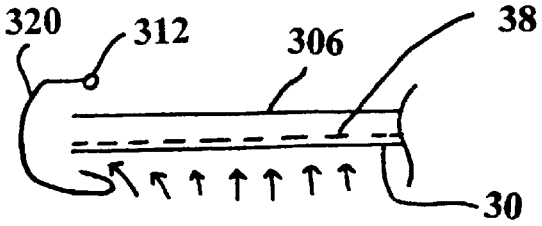

With reference to FIG. 14*a*, the invention also provides protectors 320, 322, 326, 328, and 330. As with the previously described protectors, e.g. protector 90, these are all hinged or pivoted as indicated at 312, 314, and 316. FIG. 14*b* shows the protector 320 as seen along lines 14*b* in FIG. 14*a*. Again, all of the protectors should be transparent and should swing away in the event they are contacted by a wad. FIG. 14*a* also illustrates how the protector 320 actually uses cross air jets to advantage to hold the web 30 to the felt 38.

As noted, the rolls 302/304 are rotatably supported by struts 334*a*, 334*b* and 334*c*. More or less struts may be provided. These struts connect to the supporting I beam 332. Therefore, the rolls will not sag and will easily support the felt 38, despite their comparative weakness owing to their small diameters. As shown in FIG. 16, a central shaft or vacuum duct 340 extends across the paper machine. The shaft 340 is supported conventionally at its distal ends by journals 342*a* and 342*b*, but is also supported intermediately by struts 334*c* and 334*b*. Respective outer, perforated and axially spaced shells 350*a*, 350*b* and 350*c* constitute the roll surfaces engaged by the felt 38. Note that the shells are almost in abutting relation, the distance between them being on the order of an inch or at most five inches. This assures solid support for the felt 38. The locations where the struts engages the shaft may also be used to supply vacuum and lubricant to internal components, e.g. journals, bearings, etc. FIG. 17 shows that the locations of the struts should vary within the drying section, so as not cause marking or uneven wearing of the felt 38.

Figure 18A:
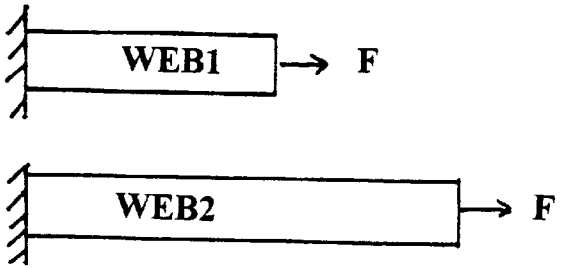
FIG. 18 is a graphic that illustrates some of the benefits of the present invention.
Figure 18B:
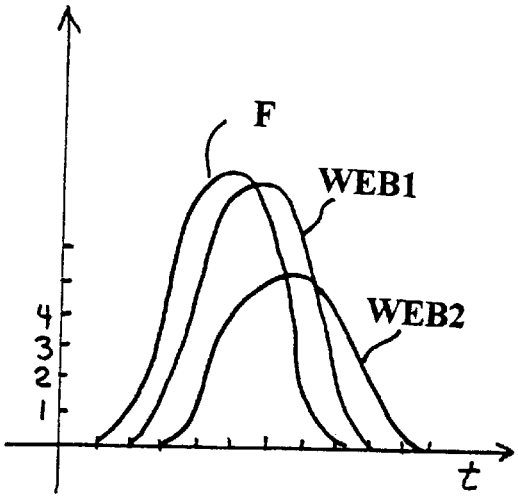

FIG. 18 serves to explain one of the advantages of the bridges 50 and/or novel rolls 302/304 of this invention. The prior art has reported explosive web breaks in the last and/or next to last dryer section, in single tier dryers. The magnitude of the problem is more severe the smaller the diameter of the vacuum rolls used. The present inventor believes that the problem may be attributed to the level of vacuum in these vacuum rolls and, more importantly, to the length of the web path between dryers. The longer the web path the less the problem.

Dryer to dryer spurious speed variations can not be totally eliminated. As a succeeding dryer jerks forward for a fraction of a second, a force pulse F (FIG. 18) is imparted to the web. The short web (web 1) has one end that is anchored at the prior dryer. The force F is therefore immediately established throughout the sheet. If the web is very dry, it has almost no stretch and it explodes. Not so with the second web (web 2) which traverses a larger vacuum roll. It takes a finite time for the force F to establish itself, and by the time it does the force pulse begins to drop, and the web never sees more than say 4.5 units of force. The web does not break. This is also the reason why the vacuum rolls in the last dryer section should be operated with no or very little vacuum. We do not want the web to be pinned everywhere on the vacuum roll, which effectively means extremely short web paths. The vacuum bridges 50 of the invention draws and microscopically flexes the felt and web. Therefore, in the event of sudden force pulse F, the web has extra "give" so to speak, which inherently resists web breaks.

The dryers and vacuum rolls of the present invention can be of any desired diametrical sizes, and their sizes may vary even within one dryer section. Some may be larger than the others. Both the VRB's and the novel vacuum rolls of FIGS. 13–17 can be constructed of several axial pieces and then interconnected after manufacturing and/or at the assembly site (the paper mill). In FIG. 12*c*', the vacuum boxes 610, 612 should be installed so as to minimize vacuum leakage, and it would be advantageous to recirculate the hot air drawn by the boxes 610, 612 and reinject the same into the drying section for energy conservation purposes. In FIG. 11 and elsewhere where use is made of the VRB's of the present invention, more of the dryer surface may be traversed by the web, e.g. as much as 90 percent or even more, by appropriate placement of the VRB's. Also, the web path length of the VRB could be increased, by selecting the VRB style of FIG. 8*b*. This might be useful where the drying section speed is higher, so as to allow the web to spend more of its time between dryers to enable the same amount (or even more) water to flash (evaporate) from the web even though it moves faster.

In general, not all of the drawings herein are drawn to scale and because of the small sizes of some of the drawings lines which touch would not do so in the actual machine. In FIGS. 12*a*–12*l*, the number of dryer sections and dryers is not intended to be exactly as depicted. The skilled artisan knows that the actual number is larger or smaller and that machine designers use computer programs to calculate the exact number of sections and dryers for each given application, e.g. paper grade, machine speed, etc.

Although the invention has been described in relation to specific embodiments thereof, the skilled artisan will recognize that there are many variations and modifications which are within the purview of the instant invention.

What is claimed is:

1. A drying section for a paper making machine, including:

at least one dryer section, each said at least one dryer section having a plurality of dryers and an associated felt, in an arrangement wherein a web to be dried proceeds from dryer to an adjacent dryer along a non-linear web path, substantially without open draw and without traversing either a felt roll or a vacuum roll.

2. The drying section of claim 1, including roller bridges between the dryers.

3. The drying section of claim 1, at least some vacuum bridges being traversed by mini-felts.

4. The drying section of claim 1, the dryers being arranged in two tiers.

5. The drying section of claim 1, including a plurality of dryer sections, some being top-felted and others being bottom-felted.

6. The drying section of claim 1, at least some of the dryers defining respective pockets and a respective demudifier in the pocket.

7. The drying section of claim 1, including a plurality of heat shields located adjacent respective ones of the dryers to prevent excessive heat from dissipating from exposed surfaces of the dryers.

8. The drying section of claim 2, the roller bridges and the felt having sliding groves and complementary projections for the felt to slide over the roller bridges.

9. The drying section of claim 2, the roller bridges having rollers that are slidably received a body of each roller bridge.

10. The drying section of claim 2, in which the roller bridges extend between dryers that are located in different dryer tiers.

11. The drying section of claim 10, including a plurality of dryer sections that are top-felted.

12. The drying section of claim 1, including a plurality of dryer sections, at least some of the dryer sections drying the paper web on both sides thereof.

13. A drying section for a paper making machine, including:

at least one dryer section, each said at least one dryer section having a plurality of dryers and an associated felt, in an arrangement wherein a web to be dried proceeds from dryer to an adjacent dryer along a non-linear web path, substantially without open draw and without traversing either a felt roll or a vacuum roll that is supported solely at distal ends thereof.

14. The drying section of claim 13, including sectioned vacuum rolls which are supported at more than three locations thereof that are spaced axially relative thereto.

15. The drying section of claim 14, the sectioned vacuum rolls having perforated, spaced shells.

16. The drying section of claim 15, including struts the support the sectioned vacuum rolls.

17. The drying section of claim 2, the roller bridges being supported by a support beam selected from the group including an "I" beam and a tube.

* * * * *